US010487484B2

(12) United States Patent
Haynes et al.

(10) Patent No.: US 10,487,484 B2
(45) Date of Patent: Nov. 26, 2019

(54) ENCASEMENT

(71) Applicant: LAKE PRODUCTS LIMITED, Rosedale, Auckland (NZ)

(72) Inventors: Andrew Leo Haynes, Auckland (NZ); Gabriel Ioan Giurgiu, Auckland (NZ)

(73) Assignee: Lake Products Limited, Rosedale, Auckland (NZ)

( * ) Notice: Subject to any disclaimer, the term of this patent is extended or adjusted under 35 U.S.C. 154(b) by 0 days.

(21) Appl. No.: 14/938,182

(22) Filed: Nov. 11, 2015

(65) Prior Publication Data

US 2016/0138251 A1 May 19, 2016

(30) Foreign Application Priority Data

Nov. 14, 2014 (NZ) ..... 702005

(51) Int. Cl.
*E03C 1/122* (2006.01)
*E03C 1/02* (2006.01)

(52) U.S. Cl.
CPC ..... *E03C 1/1222* (2013.01); *E03C 1/021* (2013.01); *E03C 1/122* (2013.01); *Y10T 137/698* (2015.04)

(58) Field of Classification Search
CPC ..... E03B 7/095; E03C 1/122; E03C 1/1222; E04F 19/08; E04F 19/083; Y10T 137/698
See application file for complete search history.

(56) References Cited

U.S. PATENT DOCUMENTS 3,148,698 A * 9/1964 Arnold ..... D06F 39/08 137/360
3,491,486 A * 1/1970 Caruth ..... E04F 19/08 174/66
3,620,404 A * 11/1971 Grasso ..... E04F 19/08 174/503
3,996,959 A * 12/1976 Caruth ..... D06F 39/08 137/360
4,410,004 A * 10/1983 Kifer ..... D06F 39/08 137/360
4,564,249 A * 1/1986 Logsdon ..... D06F 39/08 137/360
4,637,422 A * 1/1987 Izzi, Sr. ..... D06F 39/08 137/360
4,654,900 A * 4/1987 McGhee ..... E03C 1/042 4/661
5,223,673 A * 6/1993 Mason ..... H02G 3/16 174/53
5,566,708 A * 10/1996 Hobbs, Jr. ..... F16L 19/02 137/360

(Continued)

*Primary Examiner* — Kevin F Murphy
(74) *Attorney, Agent, or Firm* — Foley & Lardner LLP

(57) ABSTRACT

This invention relates to an encasement (or utility housing) for a plumbing configuration. The encasement comprises a formed enclosure, the enclosure being mountable to a wall or a part of a wall or a support structure. The formed enclosure is a first housing portion, with the first housing portion providing for a cavity space. A second housing portion is receivable by, or co-locatable with, the first housing portion, and the second housing portion is receivable or co-locatable within the cavity space of the first housing portion. At least a part of the second housing portion comprises a plumbing configuration configured to receive, or be in fluid communication with, a flow of fluid and to channel the received flow of fluid to an outlet from the plumbing configuration.

27 Claims, 28 Drawing Sheets

(56) References Cited

U.S. PATENT DOCUMENTS

| | | | | |
|---|---|---|---|---|
| 5,902,024 | A * | 5/1999 | Sutherland | G11B 33/0405 312/9.48 |
| 5,964,246 | A * | 10/1999 | Meeker | E03B 7/12 137/360 |
| 9,534,363 | B2 * | 1/2017 | Williams | E03C 1/284 |

* cited by examiner

ENCASEMENT

CROSS-REFERENCE TO RELATED APPLICATIONS

This application claims priority to New Zealand Application No. NZ 702005, filed on Nov. 14, 2014, which is hereby incorporated by reference in its entirety.

FIELD OF THE INVENTION

The present invention relates to an encasement or utility housing for a plumbing configuration, more particularly, though not solely, to an encasement or utility housing for a plumbing configuration mountable to a wall or a part of a wall or a support structure.

BACKGROUND TO THE INVENTION

Plumbing configurations, such as downpipes, or connections or traps, are traditionally exposed sections of conduit and connectors which are connected to a wall surface or another support structure through use of conduit clips or conduit supports encircling the conduit and which are then fastened to the wall surface or other support structure.

However, in some instances, there is a desire to provide for such plumbing configurations which are not exposed, or which provide other plumbing configuration benefits not previously contemplated by traditional plumbing work.

It is therefore an object of the present invention to provide an encasement or utility housing for a plumbing configuration which will go at least some way towards addressing the foregoing problems or which will at least provide the industry/public with a useful choice.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY OF THE INVENTION

In a first aspect of the invention, there is provided an encasement (or utility housing) for a plumbing configuration, comprising:

a formed enclosure, the enclosure being mountable to a wall or a part of a wall or a support structure, wherein at least a part of the enclosure comprises a plumbing configuration configured to receive, or be in fluid communication with, a flow of fluid and to channel the received flow of fluid to an outlet from the plumbing configuration or the enclosure.

In a second aspect of the invention there is provided an encasement (or utility housing) for a plumbing configuration, comprising:

a formed enclosure, the enclosure comprising at least one first housing portion and at least one second housing portion which when brought together provide for the encasement (or utility housing), the encasement being mountable to a wall or a part of a wall or a support structure, wherein one, or both, of the at least one first housing portion and/or the at least one second housing portion, comprise an associated plumbing configuration configured to receive a flow of fluid and to channel the received flow of fluid to an outlet from the plumbing configuration or the enclosure, wherein the at least one first housing portion and the at least one second housing portion are configured to be brought into connection with each other such that an encasement is provided of the plumbing configuration.

According to either one or both of the aspects defined above, one or more of the following preferred features may be provided.

Preferably the plumbing configuration is provided in-situ with the enclosure or with an associated first housing portion or an associated second housing portion.

Preferably the plumbing configuration is formed as an integral part of the enclosure, or at least a part of the enclosure, or with an associated first housing portion or an associated second housing portion.

Preferably the plumbing configuration is moulded as a part of the enclosure or with an associated first housing portion or an associated second housing portion.

Preferably the plumbing configuration is removable or may be disassociated from the enclosure or from an associated first housing portion or associated second housing portion.

Preferably the plumbing configuration is a labyrinth or serpentine arrangement pre-configured to provide for a fluid seal having a predetermined fluid weir height.

Preferably the plumbing configuration is one of: a p-shaped trap, an s-shaped trap.

Preferably the plumbing configuration provides for a fluid flow path that travels or is located substantially in the same plane, or an in-line plane, from between the inlet to the plumbing configuration to the outlet from the plumbing configuration.

Preferably the inlet to the plumbing configuration is in a plane substantially orthogonal, or different, to the plane of the fluid flow path that travels from between the inlet to the plumbing configuration to the outlet from the plumbing configuration.

Preferably the outlet from the plumbing configuration is in the same or a different plane to the plane of the fluid flow path that travels from between the inlet to the plumbing configuration to the outlet from the plumbing configuration.

Preferably the enclosure is adjustable in size.

Preferably the enclosure is self-adjustable in size.

Preferably when the enclosure is formed by the at least one first housing portion and the at least one second housing portion, the enclosure is longitudinally adjustable in length to provide for a variety of sizings, such as a larger (or longer) size of enclosure or a smaller (or shorter) size of enclosure.

Preferably two or more housing portions may be brought together to provide the enclosure.

Preferably the two or more housing portions may be co-locatable to provide for a plurality of different enclosure (i.e. assembled) sizings or relative positioning, whether substantially longitudinally with respect to each other, or whether substantially laterally with respect to each other, or both longitudinally or laterally with respect to each other.

Preferably the enclosure comprises at least one first housing portion and at least one second housing portion, one or each of the first housing portion and/or second housing portion being sleeved in an adjustable manner with respect to the other or each other housing portion.

Preferably there is an adjustable sleeving arrangement to co-locate at least one of the first housing portion or the second housing portion with respect to the other or each other housing portion.

Preferably the first housing portion is to be fixed in a mounted position.

Preferably the first housing is to be mounted to a wall or a part of a wall or support structure.

Preferably the enclosure or first housing portion includes one or more flanges for receiving fasteners and fixing to a wall or a part of a wall or a support structure.

Preferably the second housing portion comprising the plumbing configuration is adjustably co-locatable relative to or with the first housing portion.

Preferably the first housing portion and the second housing portion each comprise one or a series of co-locating devices for locating the position of at least the second housing portion with respect to the first housing portion.

Preferably the co-locating devices may be: male and female parts engageable with each other at a plurality of pre-determined engagement positions (such as along a longitudinal length of a wall of each housing portion), whether as a series of teeth or detents or castellated arrangements engageable with each other, or as one or a series of male projections and one or a series of female recesses to receive the male projections (for example, a male projection may be provided on a housing portion which is moveable, and the female recesses may be provided on a housing portion which is fixed in a mounted position).

Preferably the or a housing portion comprising the plumbing configuration may be adjusted in position relative to a housing portion that is to be fixed in a mounted position, the housing portion comprising the plumbing configuration adjusted to accommodate a fluid connection to an outlet from a fluid discharging device.

Preferably the second housing portion comprising the plumbing configuration is adjustable in position relative to the first housing portion that is to be fixed in a mounted position so as to accommodate a fluid connection between an inlet to the plumbing configuration and the outlet from a fluid discharging device.

Preferably the plumbing configuration includes a manifold.

Preferably the plumbing configuration comprises a manifold for receiving a flow (or flows) of fluid from one or more fluid discharging devices and for discharging the flow of fluid discharged from the one or more devices.

Preferably the manifold comprises a plurality of manifold inlets, each of said manifold inlets connectable to an outlet from a fluid discharging device.

Preferably the manifold receives via one or more manifold inlets a flow of fluid from one or more fluid discharging devices, and the manifold comprises at least (and preferably a single) manifold outlet for discharging the received fluid to an inlet of the plumbing configuration.

Preferably the manifold situated is upstream of the plumbing configuration.

Preferably the encasement (or utility housing), or the at least one housing portion or the at least one second housing portion, is or are each formed of one or more of the following: PVC, ABS, nylon, Polycarbonate, PP, PE, PET, PU, metals including stainless steel, galvanised steel, copper, brass.

Preferably the encasement (or utility housing) is blow-moulded or injection moulded or die-cast moulded.

Preferably the encasement is mounted in a wall cavity.

Preferably the encasement is of a depth so as to be mounted within a wall cavity.

Preferably the encasement is of a width so as to be mounted between framing members (such as supporting studs or other framing members) of a wall.

Preferably the encasement is mountable within a vanity cupboard or a utility cupboard or kitchen cupboard.

Preferably the encasement provides for a concealed plumbing configuration.

Preferably housed within the encasement is one or more water supply outlets, for example a hot and/or a cold water supply outlet.

Preferably one or more removable plugs or pop-out sections may be removed from one or more wall sections of the encasement to facilitate an access-point for providing a fluid connection to or from a conduit to be housed within the encasement.

Preferably wherein i) a first housing portion provides for a cavity space, and/or ii) a second housing portion is receivable by, or co-locatable with, the first housing portion, the second housing portion being receivable or co-locatable within the cavity space of the first housing portion.

Preferably the first housing portion defines the cavity space by at least a rear wall, and each of a pair of substantially opposing side walls and a pair of substantially opposing top and bottom walls.

Preferably inner surfaces of the each of the substantially opposing side walls of the first housing portion comprise the one or a series of co-locating devices.

Preferably the second housing portion defines the plumbing configuration, and an exterior surface or surfaces of the second housing portion is configured to engage with the one or a series of co-locating devices of the first housing portion, such an engagement being an adjustable engagement for adjusting the relative position of the second housing portion with respect to the first housing portion.

Preferably the position of the second housing portion is longitudinally adjustable with respect to the first housing portion by re-positioning the engagement of the second housing portion co-locating devices with respect to the first housing portion co-locating devices.

Preferably adjustment of the position of the second housing portion with respect to the first housing portion allows for a longitudinal re-positioning of an inlet to the plumbing configuration.

Preferably the position of the second housing portion is laterally adjustable with respect to the first housing portion by re-positioning the engagement of the second housing portion co-locating devices with respect to the first housing portion co-locating devices.

Preferably adjustment of the position of the second housing portion with respect to the first housing portion allows for a lateral re-positioning of an inlet to the plumbing configuration.

Preferably the bottom wall of the first housing portion comprises an aperture, or provision for an aperture to be made, through which a fluid connection may be made for connecting to an outlet of the plumbing configuration.

Preferably a side wall of the first housing portion comprises an aperture, or provision for an aperture to be made, through which a fluid connection may be made for connecting to an outlet of the plumbing configuration.

Preferably a side wall of the first housing portion comprises at least one aperture, or provision for at least one aperture to be made, through which a fluid connection may be made for connecting a fluid supply to a device or fixture.

Preferably the rear wall of the first housing portion comprises at least one (and preferably two) apertures, or provision for at least one aperture (or two apertures) to be made, through which a fluid connection may be made for connecting a fluid supply to a device or a fixture.

Preferably at least one flange extends about at least a part or the entirety of an exterior or perimeter of the first housing portion, the at least one flange comprising at least one pre-formed aperture through which a fastener can be secured therethrough for fastening to a wall or a part of a wall or another support structure.

Preferably one or a plurality of flanges extend from the enclosure so as provide for one or a plurality of fastening points for fixing or mounting the enclosure to a wall or a part of a wall or another support structure.

Preferably the flange(s) extend from a rear surface or rear face of the enclosure.

Preferably the flange(s) extend from the enclosure to provide a stand-off position of the enclosure from a surface or wall or a part of a wall or another support structure to which the flanges are to be affixed or fastened.

Preferably a fluid connection may be made with the outlet of the plumbing configuration, the fluid connection being maintained regardless of the re-positioning of the plumbing configuration with respect to the encasement or the re-positioning of the second housing portion with respect to the first housing portion.

Preferably a pre-determined length of the plumbing configuration at and upstream from the outlet from the plumbing configuration is configured to receive a conduit, the conduit extending at least a part of the pre-determined length.

Preferably the plumbing configuration is configured to receive the conduit internally.

Preferably the pre-determined length of the plumbing configuration has a larger internal diameter than the internal diameter of the remaining fluid flow pathway of the plumbing configuration more upstream.

Preferably an internal diameter of the plumbing configuration extending from the outlet of the plumbing configuration to a predetermined distance upstream is greater than the internal diameter of the plumbing configuration still more upstream.

Preferably for a predetermined length of the fluid flow pathway of the plumbing configuration adjacent to and immediately upstream from the outlet from the plumbing configuration is of a larger internal diameter than the internal diameter of the plumbing configuration still further upstream.

Preferably the fluid flow pathway of the plumbing configuration is of a predetermined internal diameter, with the internal diameter being larger for a particular length of the fluid flow pathway terminating at the outlet from the plumbing configuration.

Preferably the outlet from the plumbing configuration, and for a particular length of the plumbing configuration immediately upstream from the outlet, the plumbing configuration is configured to internally receive a conduit or pipe therein without interrupting or an interruption to the fluid flow pathway of fluid being discharged from the plumbing configuration.

Preferably an outlet from the encasement is configured to accommodate a lateral positioning of a second housing portion with respect to the first housing portion, and the relative lateral movement or lateral re-positioning of the outlet from the plumbing configuration.

Preferably a lid or cover is provided to conceal the cavity space of the enclosure.

Preferably a lid or cover is securely fastened to the enclosure to protect the cavity space from unauthorised access.

In a third aspect of the invention there is provided an encasement (or utility housing) for a plumbing configuration, comprising:

a formed enclosure, the enclosure being mountable to a wall or a part of a wall or a support structure, the formed enclosure being a first housing portion, the first housing portion providing for a cavity space, and wherein a second housing portion is receivable by, or co-locatable with, the first housing portion, the second housing portion being receivable or co-locatable within the cavity space of the first housing portion, and wherein at least a part of the second housing portion comprises a plumbing configuration configured to receive, or be in fluid communication with, a flow of fluid and to channel the received flow of fluid to an outlet from the plumbing configuration.

Preferably the plumbing configuration or the second housing portion is: provided in-situ with, formed as an integral part of, or moulded as a part of, a first housing portion or a second housing portion.

Preferably the plumbing configuration is removable or may be disassociated from the enclosure or from an associated first housing portion or associated second housing portion.

Preferably the plumbing configuration is a labyrinth or serpentine arrangement pre-configured to provide for a fluid seal having a predetermined fluid weir height.

Preferably the plumbing configuration is one of: a p-shaped trap, an s-shaped trap.

Preferably the plumbing configuration provides for a fluid flow path that travels or is located substantially in the same plane, or an in-line plane, from between the inlet to the plumbing configuration to the outlet from the plumbing configuration.

Preferably the inlet to the plumbing configuration is in a plane substantially orthogonal, or different, to the plane of the fluid flow path that travels from between the inlet to the plumbing configuration to the outlet from the plumbing configuration.

Preferably the outlet from the plumbing configuration is in the same or a different plane to the plane of the fluid flow path that travels from between the inlet to the plumbing configuration to the outlet from the plumbing configuration.

Preferably the enclosure is adjustable in size.

Preferably the first housing is to be mounted to a wall or a part of a wall or support structure.

Preferably the enclosure or first housing portion includes one or more flanges for receiving fasteners and fixing to a wall or a part of a wall or a support structure.

Preferably the first housing portion and the second housing portion each comprise one or a series of co-locating devices for locating the position of at least the second housing portion with respect to the first housing portion.

Preferably the co-locating devices are: male and female parts engageable with each other at a plurality of pre-determined engagement positions, whether as a series of teeth or detents or castellated arrangements engageable with each other, or as one or a series of male projections and one or a series of female recesses to receive the male projections.

Preferably the second housing portion comprising the plumbing configuration is adjustable in position relative to the first housing portion that is to be fixed in a mounted position so as to accommodate a fluid connection between an inlet to the plumbing configuration and an outlet from a fluid discharging device.

Preferably the encasement or plumbing configuration comprises a manifold for receiving a flow (or flows) of fluid from one or more fluid discharging devices and for discharging the flow of fluid discharged from the one or more devices.

Preferably the encasement provides for a concealed plumbing configuration.

Preferably housed within the encasement is one or more water supply outlets.

Preferably one or more removable plugs or pop-out sections are removable from one or more wall sections of the encasement to facilitate an access-point for providing a fluid connection to or from a conduit to be housed within the encasement.

Preferably inner surfaces of substantially opposing side walls of the first housing portion comprise the one or a series of co-locating devices.

Preferably an exterior surface or surfaces of the second housing portion is configured to engage with the one or a series of co-locating devices of the first housing portion, such an engagement being an adjustable engagement for adjusting the relative position of the second housing portion with respect to the first housing portion.

Preferably the position of the second housing portion is longitudinally adjustable, or laterally adjustable, or both, with respect to the first housing portion by re-positioning the engagement of the second housing portion co-locating devices with respect to the first housing portion co-locating devices.

Preferably an adjustment of the position of the second housing portion with respect to the first housing portion allows for a longitudinal, lateral, or both longitudinal and lateral, re-positioning of an inlet to the plumbing configuration.

Preferably the first housing portion comprises an aperture, or provision for an aperture to be made, through which a fluid connection is made for connecting to an outlet of the plumbing configuration, or for connecting a fluid supply to a device or fixture, the aperture or provision for the aperture to be made being provided in or through one or more of: a bottom wall, a side wall, a rear wall.

Preferably a fluid connection is made with the outlet of the plumbing configuration, the fluid connection being maintained regardless of a re-positioning of the plumbing configuration with respect to the encasement or a re-positioning of the second housing portion with respect to the first housing portion.

Preferably a pre-determined length of the plumbing configuration at and upstream from the outlet from the plumbing configuration is configured to receive a conduit, the conduit extending at least a part of the pre-determined length.

Preferably the pre-determined length of the plumbing configuration has a larger internal diameter than the internal diameter of the remaining fluid flow pathway of the plumbing configuration more upstream.

Preferably the outlet from the plumbing configuration, and for a particular length of the plumbing configuration immediately upstream from the outlet, is configured to internally receive a conduit or pipe therein without interrupting or an interruption to the fluid flow pathway of fluid being discharged from the plumbing configuration.

Preferably a lid or cover is provided to conceal the cavity space of the enclosure.

Preferably a lid or cover is securely fastened to the enclosure to protect the cavity space from unauthorised access.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

Figure 7A:
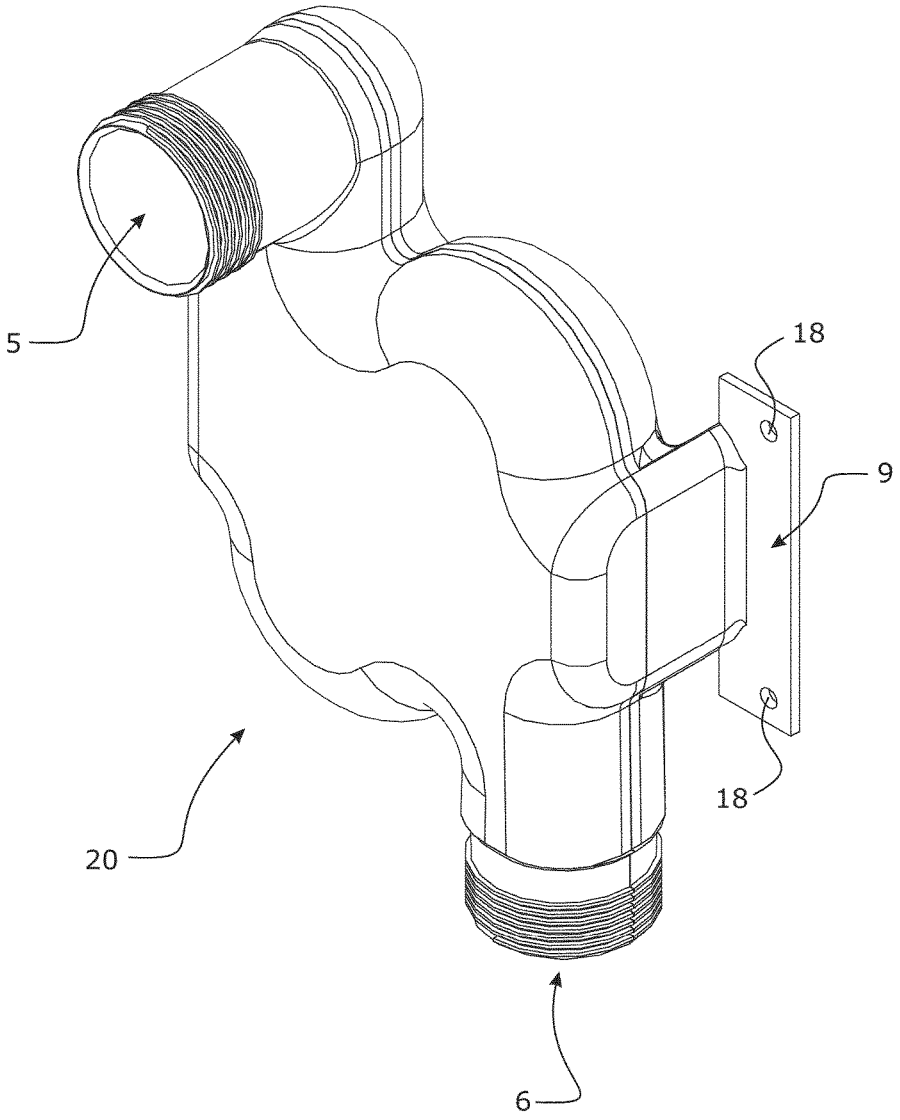
FIG. 7A is a front perspective view of yet another embodiment of a housing portion comprising a plumbing configuration or arrangement.

7B is a front-side view of the embodiment of FIG. 7A.

Figure 7B:
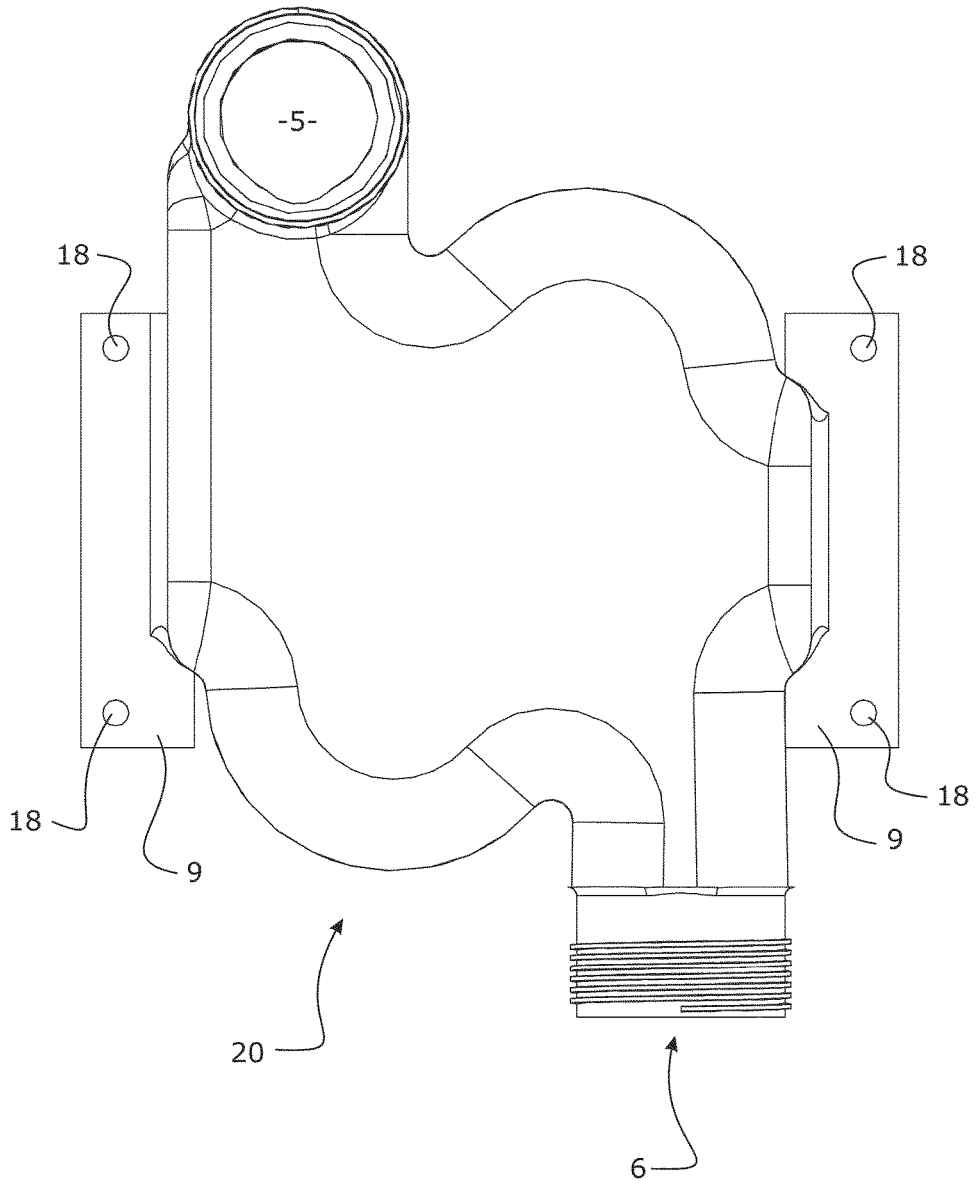
Figure 7C:
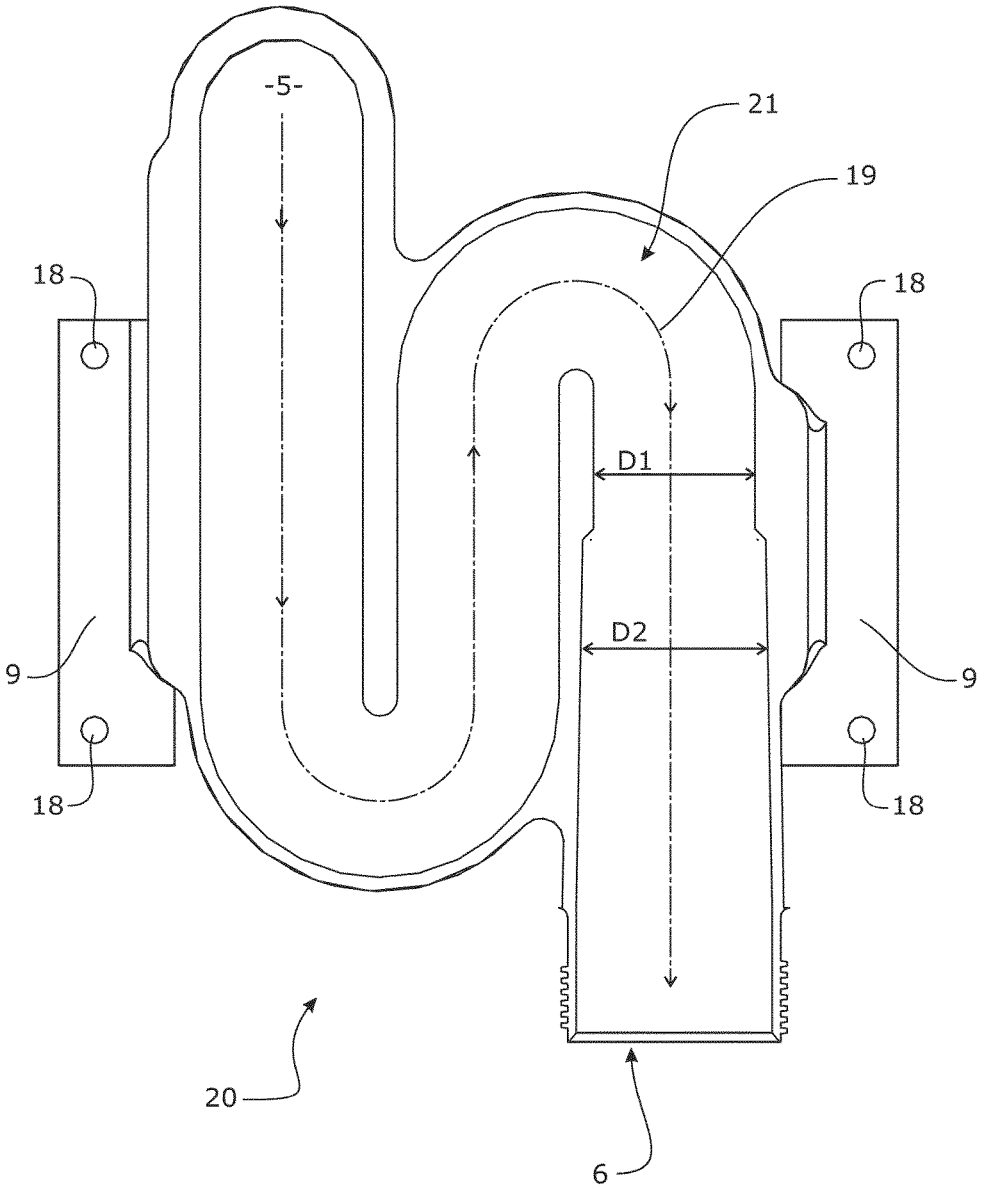

FIG. 7C is a cross-section through the embodiment of FIG. 7B.

Figure 7D:
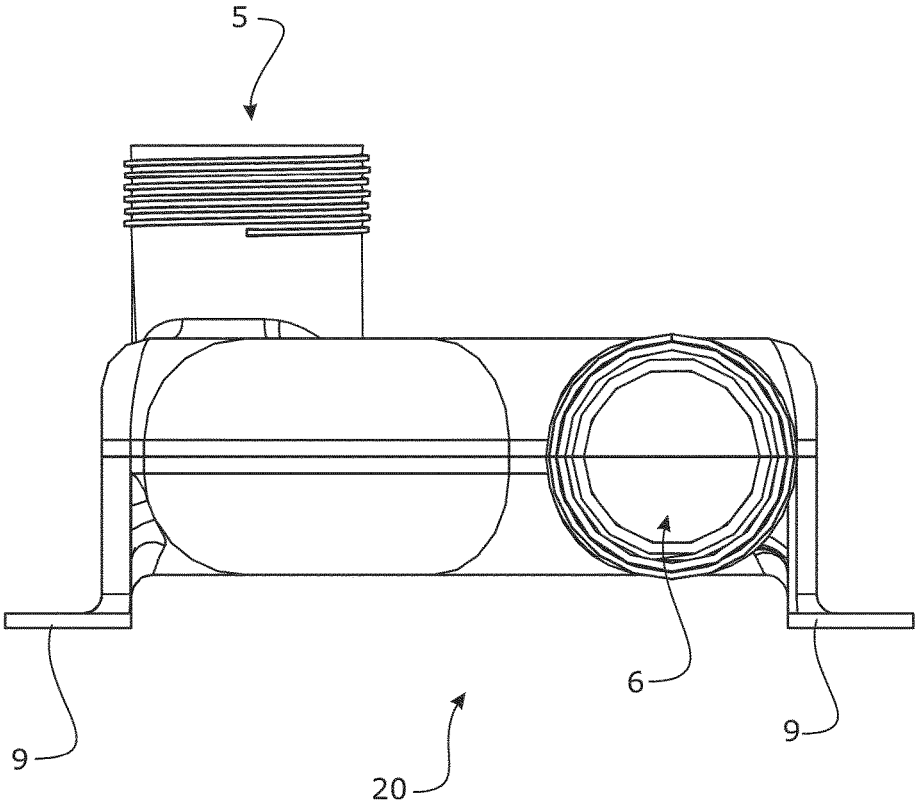

FIG. 7D is a bottom view of the embodiment of FIG. 7B.

Figure 8:
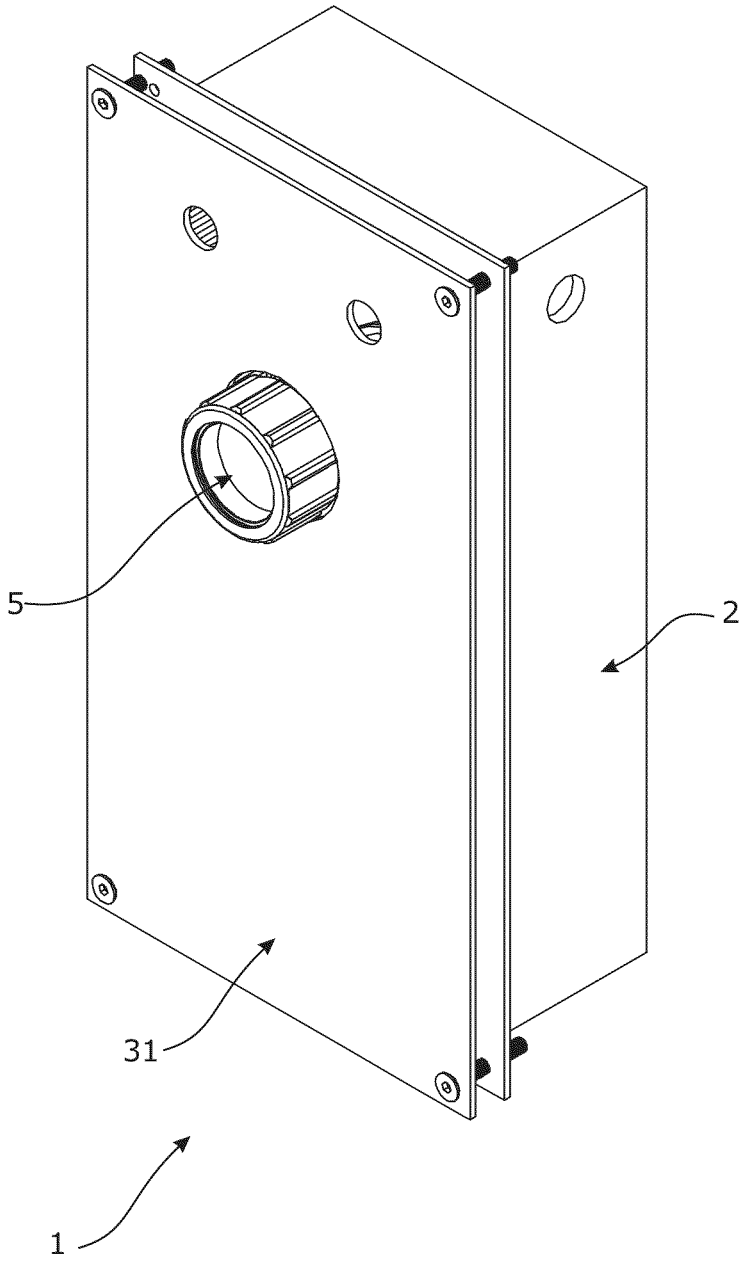

FIG. 8 illustrates an embodiment of an encasement in which a cover or lid or other face-plate is provided.

Figure 9A:
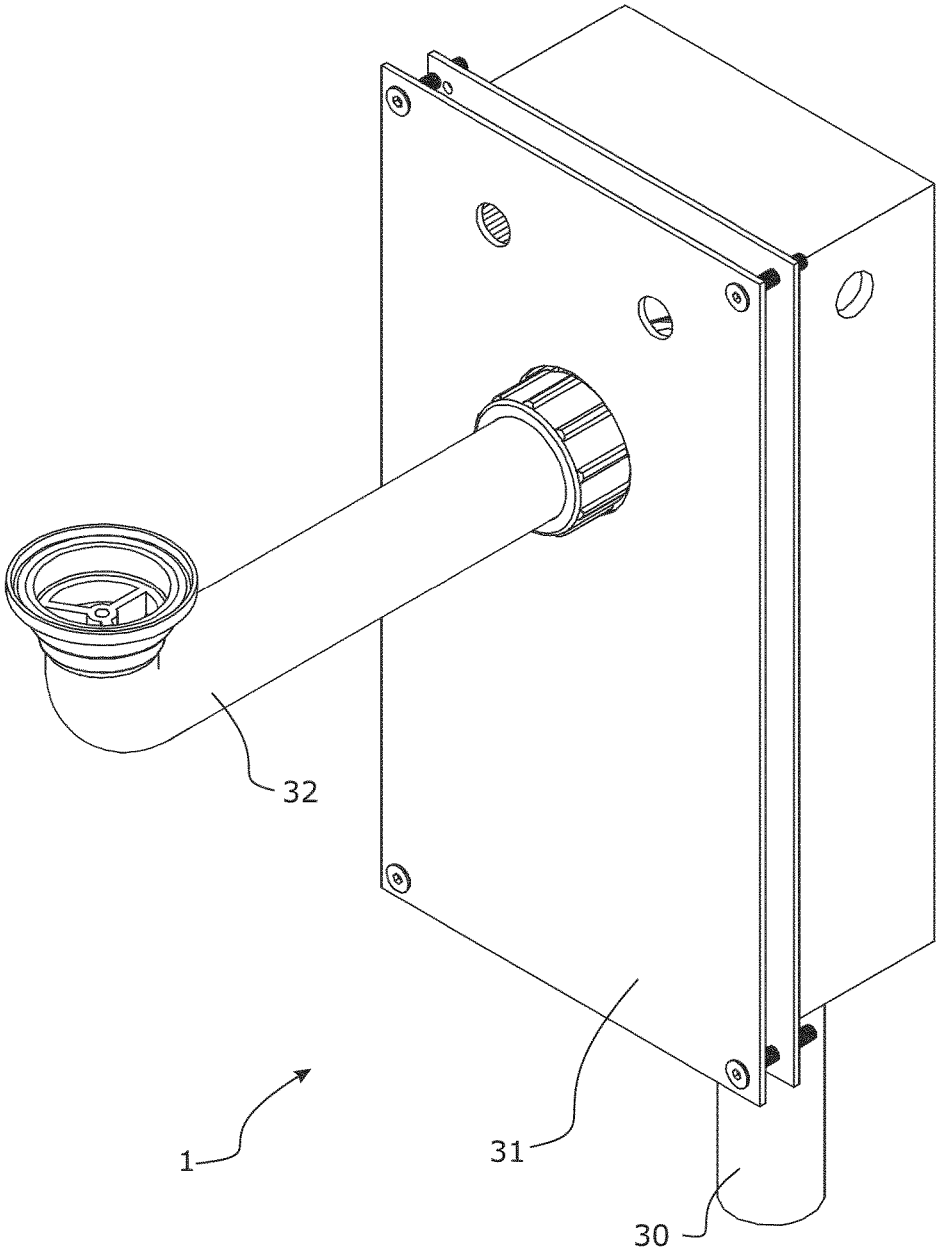

FIG. 9A illustrates an embodiment of an encasement in which a fluid connection is made with the inlet to the plumbing configuration from, for example, a sink outlet.

Figure 9B:
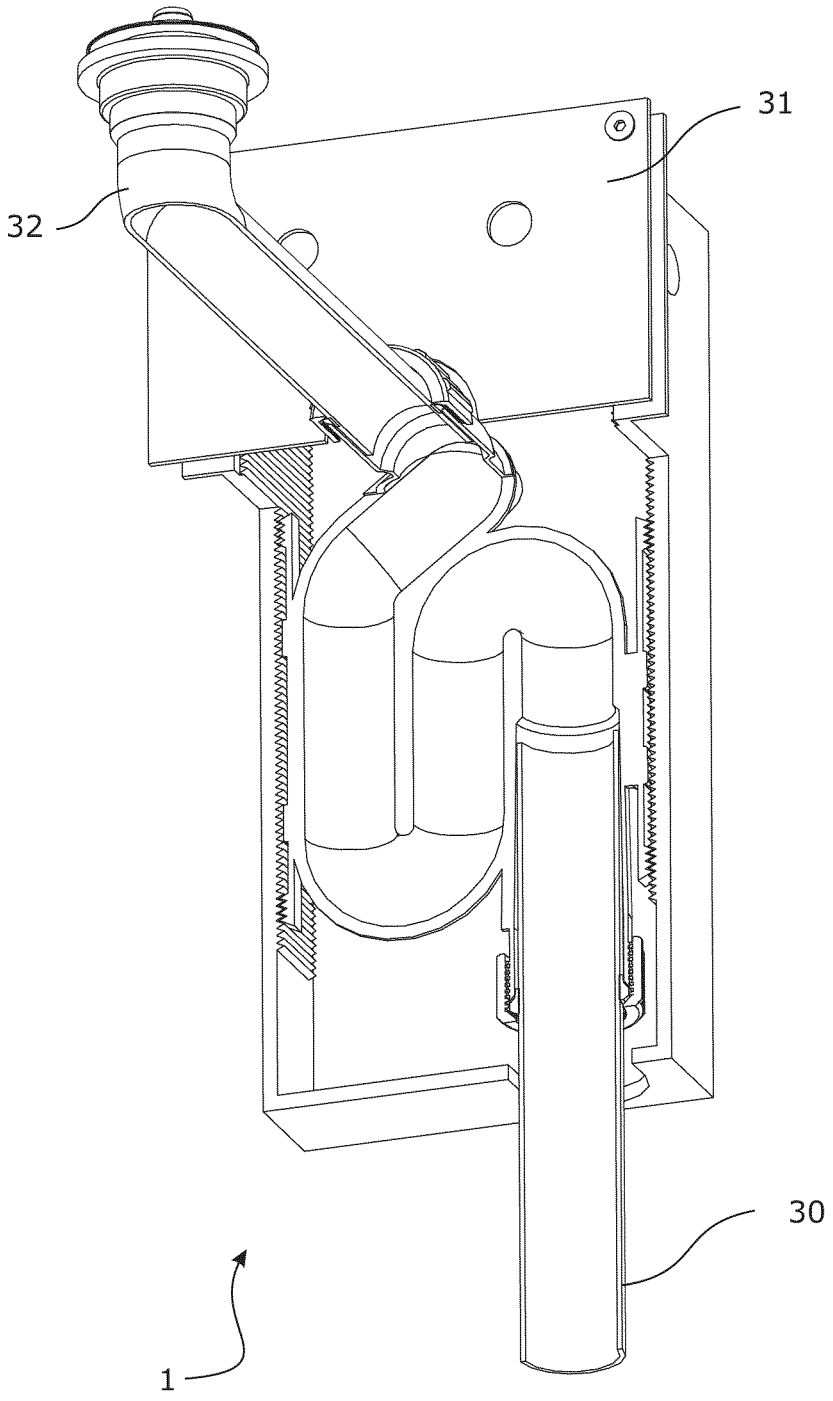

FIG. 9B is a partial section view through FIG. 9A to illustrate the cavity space and arrangement of a second housing portion within a first housing portion and the fluid connections made to both the inlet and outlet of the plumbing configuration.

DETAILED DESCRIPTION OF PREFERRED EMBODIMENTS

The provision of a product, whether as an assembly of components, or as a pre-formed configuration, in which a plumbing configuration is housed provides for particular advantages.

In particular, one advantage is where that product is capable of being wall mounted or mounted to a part of a wall or another support structure, but preferably where the product is sufficiently slim-line or of a maximum depth that allows the product to be located within the cavity of a wall between wall framing members. As a result, a plumbing configuration can be housed and located within or by or as part of the product.

For example, advantageously in one embodiment, the product may be an encasement or utility housing which is assembled from the assembly or connection (or otherwise a form of engagement) of a first housing portion or part (of the encasement) that is receivable of a second housing portion or part (to complete the encasement once received by the first housing portion or part). The first housing portion or part may facilitate, generally, a housing which is mountable to a support structure, such as a wall or a part of a wall (or other structures). The first housing portion being a housing has a cavity space for receiving of the second housing portion therein. The second housing portion may comprise of a plumbing configuration or arrangement. The second housing portion can be position adjusted relative to the first housing portion. For example, the second housing portion may be height adjusted or adjusted in a longitudinal direction with respect to the first housing portion within which it is to be received.

Other embodiments or variants of such a product will now be described with reference to the accompany figures and description below.

In another embodiment, there is provided an encasement (or utility housing) for a plumbing configuration. The encasement comprises a formed enclosure, the enclosure being mountable to a wall or a part of a wall or other support structure. At least a part of the enclosure comprises or includes a plumbing configuration configured to receive, or be in fluid communication with, a flow of fluid (e.g. being an inlet of the plumbing configuration that is fluidly connectable to, or in fluid communication with, a waste outlet of at least one device or fitting or fixture, such as a wash basin, sink, or other appliance requiring discharge of fluid, including but not limited to such as a dishwasher, washing machine, condensing dryer) and to channel the received flow of fluid to an outlet from the plumbing configuration or the enclosure (e.g. an outlet of the plumbing configuration is fluidly connectable to a waste discharge to drain the flow of fluid).

In another embodiment, there is provided an encasement (or utility housing) 1 for a plumbing configuration. The encasement 1 comprises a formed enclosure, the enclosure comprising at least one first housing portion 2 and at least one second housing portion 3 which when brought together provide for the encasement (or utility housing) 1.

The encasement 1 can be mountable to a wall or a part of a wall or another support structure. Although it will be appreciated the encasement may be mounted or positioned anywhere suitable where enough of a support, for example use of fasteners or other systems, may be employed so the encasement is located and held sufficiently for the operational requirements of the encasement and the housing plumbing configuration.

In certain embodiments, one, or both, of the at least one first housing portion 2 and/or the at least one second housing portion 3, comprise an associated plumbing configuration 4 configured to receive a flow of fluid (e.g. being an inlet 5 of the plumbing configuration that is fluidly connectable to, or in fluid communication with, a waste outlet (not shown) of at least one device, such as a wash basin, sink, or other appliance requiring discharge of fluid, including but not limited to such as a dishwasher, washing machine, condensing dryer) and to channel the received flow of fluid to an outlet 6 from the plumbing configuration or the enclosure 7 (e.g. an outlet of the plumbing configuration is fluidly connectable to a waste discharge to drain the flow of fluid), The at least one first housing portion 2 and the at least one second housing portion 3 are configured to be brought into connection or engagement with each other such that an encasement 1 is provided of the plumbing configuration 4.

Figure 1:
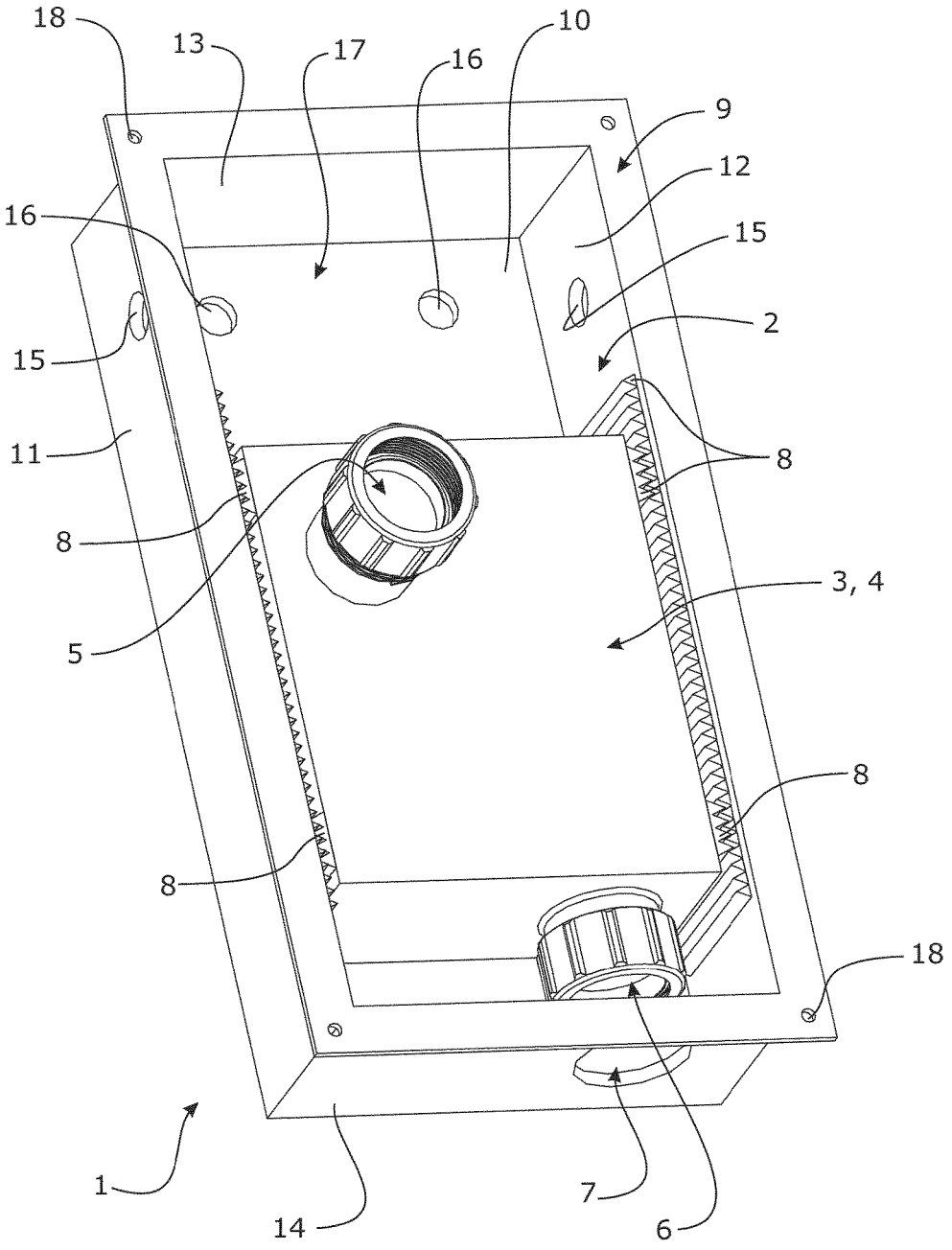
FIG. 1 illustrates a perspective view of an encasement arrangement (or utility housing) with a second housing portion comprising a plumbing configuration or arrangement received within a first housing portion.

The plumbing configuration 4 can be provided in-situ with the enclosure or with an associated first housing portion 2 or an associated second housing portion 3. For example, the plumbing configuration 4 can be formed as an integral part of the enclosure, or at least a part of the enclosure, or with an associated first housing portion 2 or an associated second housing portion 3. FIG. 1 illustrates an embodiment in which the plumbing configuration 4 is provided as a part of, or which may be at least separately housed by or within, the second housing portion 3.

In a preferred embodiment, the plumbing configuration 4 is moulded or formed as a part of the enclosure or with an associated first housing portion 2 or an associated second housing portion 3 itself.

In an alternative embodiment, the plumbing configuration 4 can be removable or may be disassociated from the enclosure or from an associated first housing portion 2 or associated second housing portion 3.

It yet further embodiments, where a failure of the plumbing configuration or arrangement occurs, a replacement plumbing configuration can be provided. For example, where the plumbing configuration 4 is provided as an integral part of the second housing portion 3, then a replacement second housing portion 3 can be supplied for re-installation to the enclosure or to be received by the first housing portion 2. Alternatively, the enclosure or the second housing portion 3 may be accessed to repair or replace parts of the entirety of the plumbing configuration provided or housed therein. Still further, the enclosure or the second housing portion 3 and the plumbing configuration may be accessed to unblock or remove an obstruction from within the fluid flow pathway of the plumbing configuration.

A particularly preferred plumbing configuration 4 may be a labyrinth-type or serpentine-type arrangement pre-configured to provide for a fluid seal having a predetermined fluid weir height. For example, such a plumbing configuration 4 could be comprised of the following trap arrangements, or may be one the following trap arrangement itself; a p-shaped trap or an s-shaped trap.

FIG. 6 illustrates a sectioned view through a part of a second housing portion 3, illustrating a trap arrangement formed as part of the second housing portion, which is installed in the cavity space 17 of a first housing portion 2.

The plumbing configuration 4, or the second housing portion 3, can provide for a fluid flow path, such as that identified by the dashed line labelled item 19, that travels or is located substantially in the same plane, or an in-line plane, when travelling from between the inlet 5 to the plumbing configuration to the outlet 6 from the plumbing configuration 4. For example, see FIG. 6 in which illustrates such an in-line or same plane plumbing configuration, noting the fluid flow path identified as item 19.

An in-line or same plane plumbing configuration can facilitate for relatively compact, or shallow depth of a plumbing configuration to allow for an in-wall or relatively shallow plumbing configuration which still provides for a suitable labyrinth or serpentine or trap type configuration to enable a fluid seal.

The (or an) inlet 5 to the plumbing configuration 4 can be in a plane substantially orthogonal, or different, to the plane of the fluid flow path that travels from between the inlet 5 to the plumbing configuration to the outlet 6 from the plumbing configuration.

The outlet 6 from the plumbing configuration 4 can be in the same or a different plane to the plane of the fluid flow path that travels from between the inlet 5 to the plumbing configuration to the outlet 6 from the plumbing configuration.

Where for example the outlet 6 from the plumbing configuration terminates substantially horizontally or for example through a side wall of the enclosure or second housing portion 3, then a corresponding aperture or outlet from the enclosure 7 is to be provided. FIG. 1 illustrates an outlet 7 from the enclosure through a bottom wall or floor of the enclosure or first housing portion 2. Where the outlet 6 is to terminate out through a side wall of the enclosure or first housing portion 2, then a suitable aperture or access-point is to be provided to establishing such a fluid connection for the subsequent drainage or discharge of fluid from the outlet 6 of the plumbing configuration 4.

As a part of the encasement 1, it is contemplated that the enclosure or respective connection or engagement of a first housing portion 2 and a second housing portion 3 can be adjustable relative to each other for an adjustment of the enclosure sizing or for a certain positioning of the enclosure of one of the first or the second housing portions to more easily or suitably fluidly connect or be connectable to other fluid connections (e.g. discharge pipes or conduits from devices or fittings or appliances noted previously). In certain embodiments, the enclosure is self-adjustable in size or the relative positioning of at least one of the first or the second housing portions 2, 3 with respect to each other.

The enclosure 1 can be longitudinally adjustable in length to provide for a variety of sizings, such as a larger (or longer) size of enclosure or a smaller (or shorter) size of enclosure, or for the re-positioning or more suitable positioning of for example the inlet 5 to the plumbing configuration 4.

In a particularly preferred arrangement of the encasement 1, two or more housing portions (such as a first housing portion 2 and a second housing portion 3) may be brought together to provide the enclosure 1.

The two or more housing portions can be co-locatable to provide for a plurality of different enclosure (i.e. assembled) sizings or relative positioning of each such portion, such as the second housing portion 3 relative to the first housing portion 2 which may be fixedly mounted or fastened to a support structure.

The enclosure 1 for example comprises at least one first housing portion 2 and at least one second housing portion 3, one or each of the first housing portion 2 and/or second housing portion 3 can be substantially sleeved in an adjustable manner with respect to the other or each other housing portion. The sleeving may be an adjustable sleeving arrangement so as to provide for co-locating or co-location abilities, for example using co-locating devices 8, of at least one of the first housing portion 2 or the second housing portion 3 with respect to the other or each other housing portion.

In one embodiment, the first housing portion 2 is to be fixed in place or position, such as a mounted position. The mounted position can be against or on or within a wall or wall cavity or a part of a wall, or another support structure. The first housing portion 2 can include one or more flanges 9 for receiving fasteners or other fixings and for fixing to a wall or a part of a wall or a support structure. In such an arrangement, the second housing portion 3 would typically comprise the plumbing configuration 4 which is then adjustably co-locatable (e.g. by engagement or other connection systems) to or with the first housing portion 2.

The first housing portion 2 and the second housing portion 3 can each comprise respective ones of or a series of co-locating devices 8 for locating the position of at least the second housing portion 3 with respect to the first housing portion 2.

The co-locating devices 8 may for example be one or more of the following, although it will be appreciated other systems may be utilised to engaging or connecting each housing portion to the other: male and female parts engageable with each other at a plurality of pre-determined engagement positions (such as along a longitudinal length of a wall of each housing portion), whether as a series of teeth or detents or castellated arrangements engageable with each other, or as one or a series of male projections and one or a series of female recesses to receive the male projections (for example, a male projection may be provided on a housing portion which is moveable, and the female recesses may be provided on a housing portion which is fixed in a mounted position).

Yet further, a or the housing portion (such as the second housing portion 3) comprising the plumbing configuration 4 may be adjusted in position relative to a or the housing portion (such as the first housing portion) that is to be fixed in a mounted position, the housing portion comprising the plumbing configuration 4 being adjusted to accommodate a fluid connection to an outlet from a fluid discharging device. In this arrangement, the second housing portion 3 comprises the plumbing configuration 4 and is adjustable in position relative to the first housing portion 2 that is to be fixed in a mounted position so as to accommodate a fluid connection between an inlet 5 to the plumbing configuration and the outlet from a fluid discharging device (not shown).

Yet still further, the plumbing configuration may include a manifold, such as a collection manifold for collecting fluid from one or multiple sources of fluid. For example, such a manifold can be utilised for receiving a flow (or flows) of fluid from one or more fluid discharging devices and for discharging the flow of fluid discharged from the one or more devices.

Such a manifold can comprise a plurality of manifold inlets, each of said manifold inlets connectable to an outlet from a fluid discharging device. The manifold can receive, via one or more manifold inlets, a flow of fluid from one or more fluid discharging devices, and the manifold may optionally comprise of at least one (and preferably a single) manifold outlet for discharging the received fluid to the inlet 5 of the plumbing configuration 4.

Where a manifold is to be utilised for communal receipt and collection of fluid from multiple discharging devices, or alternatively as a collection chamber for any flow of fluid (whether a single source or multiple sources), the manifold would be situated upstream of the plumbing configuration. The manifold could then discharge via a single outlet to the plumbing configuration 4.

In yet another embodiment, and with reference to the various other embodiments, the encasement 1 includes a first housing portion 2 which provides for a cavity space 17. A second housing portion 3 is then receivable by, or co-locatable with, the first housing portion 2, the second housing portion 3 being receivable or co-locatable within the cavity space 17.

The cavity space 17 of the first housing portion 2 can be defined by at least a rear wall 10, and each of a pair of substantially opposing side walls 11, 12 and a pair of substantially opposing top and bottom walls 13, 14.

Inner surfaces of the each of the substantially opposing side walls 11, 12 of the first housing portion 2 comprise the one or a series of co-locating devices 8. Outer or exterior surface or surfaces of the second housing portion 3 is/are configured to engage with the one or a series of co-locating devices 8 of the first housing portion 2, such an engagement being an adjustable engagement for adjusting the relative position of the second housing portion with respect to the first housing portion. For example, the second housing portion may be removed from engagement with the first housing portion and then re-inserted into a new location or position; alternatively, the co-locating devices may be configured to allow for such an in-situ adjustment.

The position of the second housing portion 3 can be longitudinally adjustable with respect to the first housing portion 2 by re-positioning the engagement of the second housing portion co-locating devices with respect to the first housing portion co-locating devices. In such a re-positioning, the inlet 5 of the plumbing configuration 4 can be moved or relocated (for example up or down within the cavity space 17).

The bottom wall 14 (or floor) of the first housing portion 2 can comprise of at least one aperture or outlet 7, or provision for such an aperture or outlet can be made, through which a fluid connection is then able to be made with the outlet 6 of the plumbing configuration 4.

A side wall, such as that identified as item 11 or 12 of the first housing portion 2 can comprise one or more apertures, or provision for such apertures can be made, through which a fluid connection is then able to be made for connecting to an outlet 6 of the plumbing configuration 4 (when the outlet 6 is oriented to terminate through a side wall of the second housing portion 3 and be connected thereto out through a side wall of the first housing portion 2.

In still further embodiments, a side wall 11, 12 of the first housing portion 2 can comprise of at least one aperture 15, or provision for at least one aperture can be made, through which a fluid connection may be made for connecting a fluid supply to a device or fixture.

In still further embodiments, the rear wall 9 of the first housing portion 2 can comprise of at least one (and preferably two) apertures 16, or provision for at least one aperture (or two apertures) can be made, through which a fluid connection may be made for connecting a fluid supply to a device or a fixture. For example, a hot water supply line may pass through one of the rear wall apertures 16, whilst a cold water supply line may pass through the other of the rear wall apertures 16, these supply lines may then be fluidly connected to various devices or appliances of fixtures, which the necessary pipe or conduit or further supply lines passing out through the apertures 15 in the side walls of the first housing portion 2.

At least one flange 9 extends about an exterior or perimeter of the first housing portion 2, the at least one flange 9 comprising at least one pre-formed aperture 18 through which a fastener can be secured therethrough for fastening to a wall or a part of a wall or another support structure.

Figure 2:
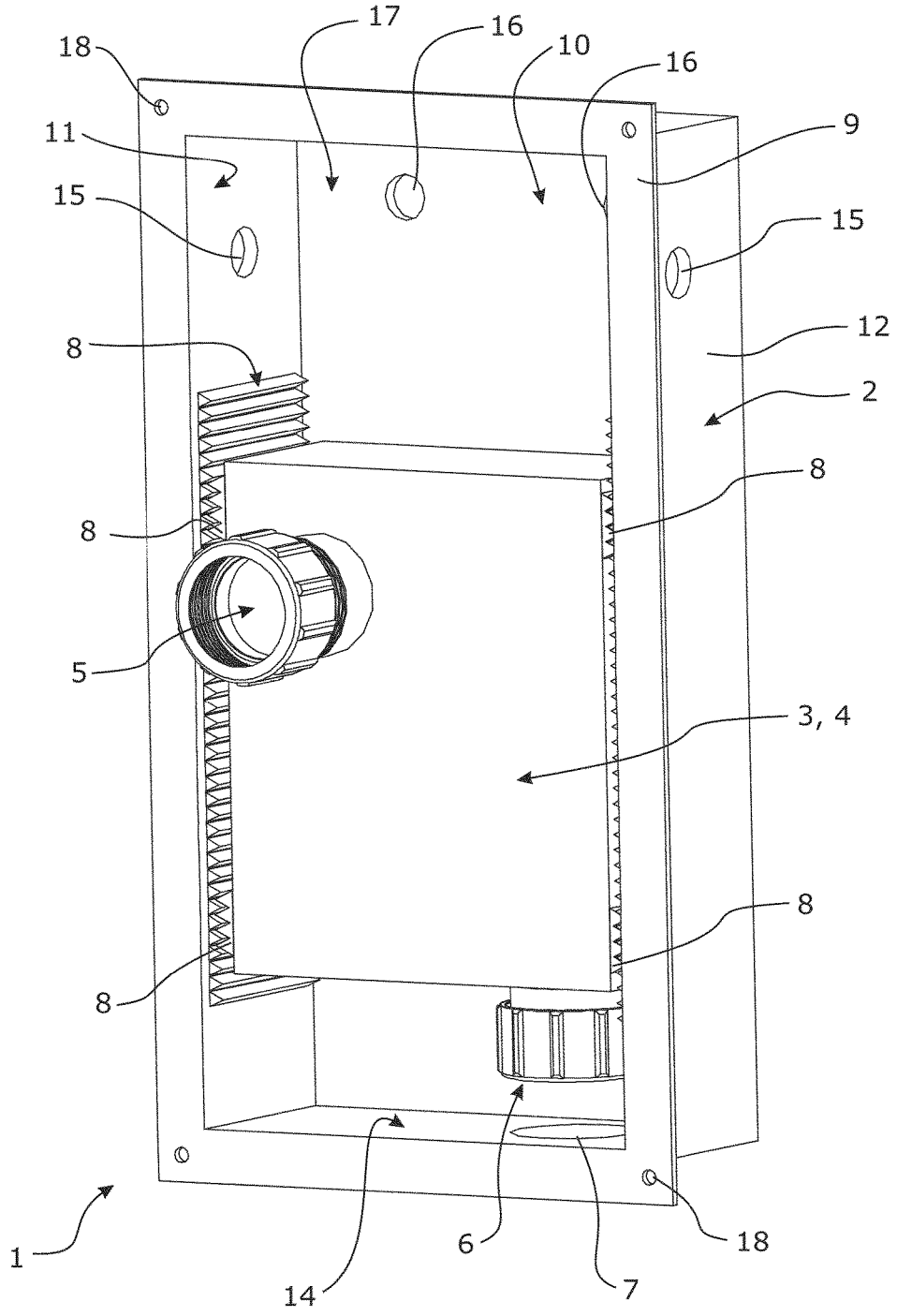
FIG. 2 illustrates the embodiment of FIG. 1 from a different angle.
Figure 3:
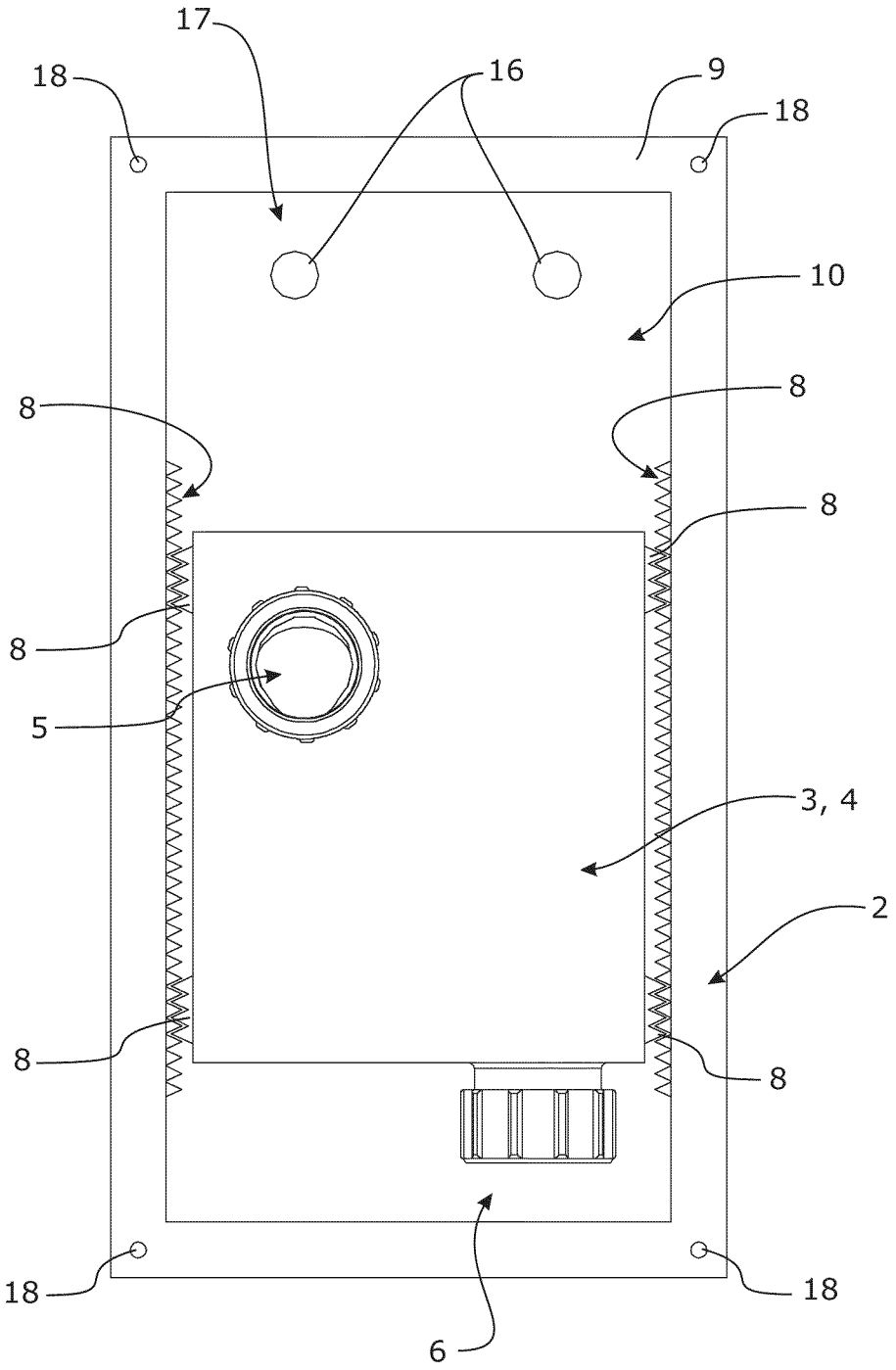
FIG. 3 illustrates a front view of the encasement arrangement of FIGS. 1 and 2.

FIGS. 1-3 illustrate at least a first embodiment of an encasement 1 in which a first housing portion 2 has a second housing portion 3 installed therein. The second housing portion may be adjusted in position by either sliding the second housing portion up and down (i.e. longitudinally) with respect to the first housing portion 2 (and the associated engagement etc of the co-locating device teeth 8 on each of the housing portions 2, 3), or by entirely removing the second housing portion 3 from the first housing portion 2, and then re-establishing their union upon correct re-positioning. Re-positioning of the second housing portion 3 is provided so that the inlet 5 to the plumbing configuration or arrangement 4 can be best positioned for making a fluid connection to the outlet of a device or appliance of other fluid (e.g. liquid) discharging device. It will be noted that the outlet 7 in the first housing portion 2 is longitudinally aligned with the outlet 6 of the plumbing configuration 4.

Figure 4A:
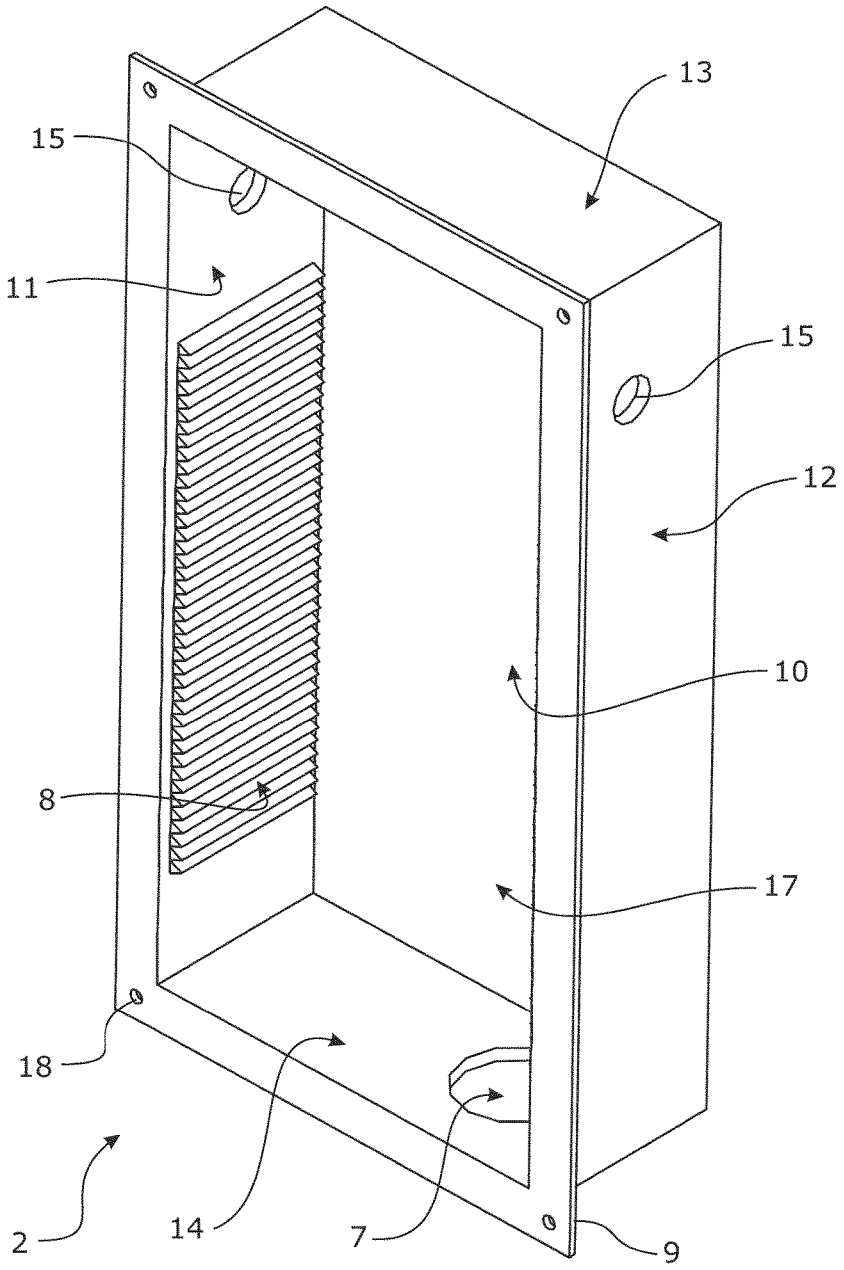
FIG. 4A illustrates a perspective view of one embodiment of a first housing portion with a cavity space and co-locating devices (and other details) without a second housing portion installed therein.
Figure 4B:
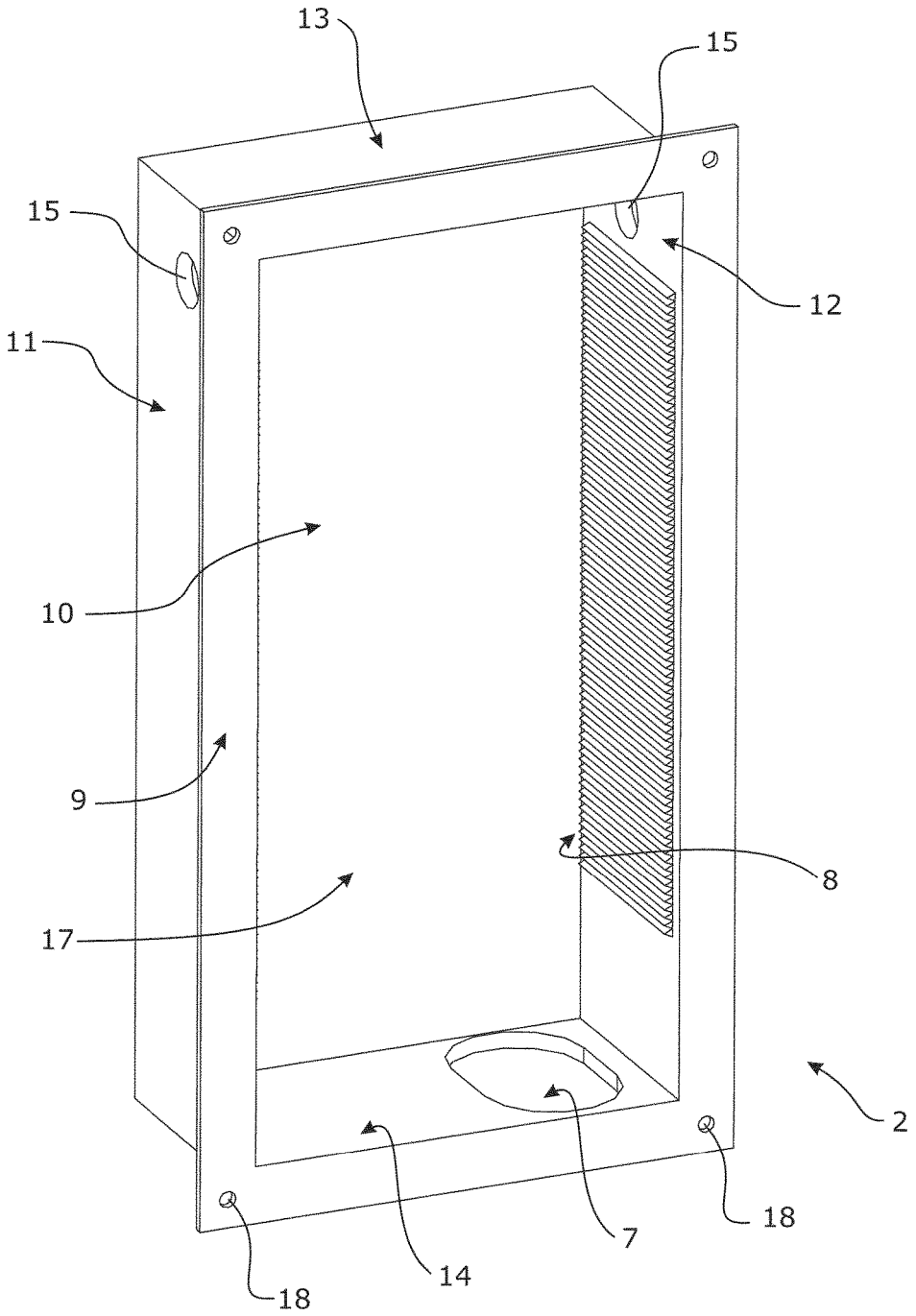
FIG. 4B illustrates a perspective view of an alternative embodiment of a first housing portion with a cavity space and co-locating devices (and other details) without a second housing portion installed therein.

Optionally, and as shown in other embodiments, the outlet 7 may be configured so as to allow for a lateral positioning of the second housing portion within the first housing portion, and yet a fluid connection may still be made with the outlet 6 through the outlet 7. For example, FIG. 4A illustrates a first housing portion without a plumbing configuration installed therein, and the outlet 7 is shown. FIG. 4B illustrates the same arrangement, but note the elongated outlet 7 configured to allow for such lateral positioning of the second housing portion (and thereby the outlet 6).

Figure 5A:
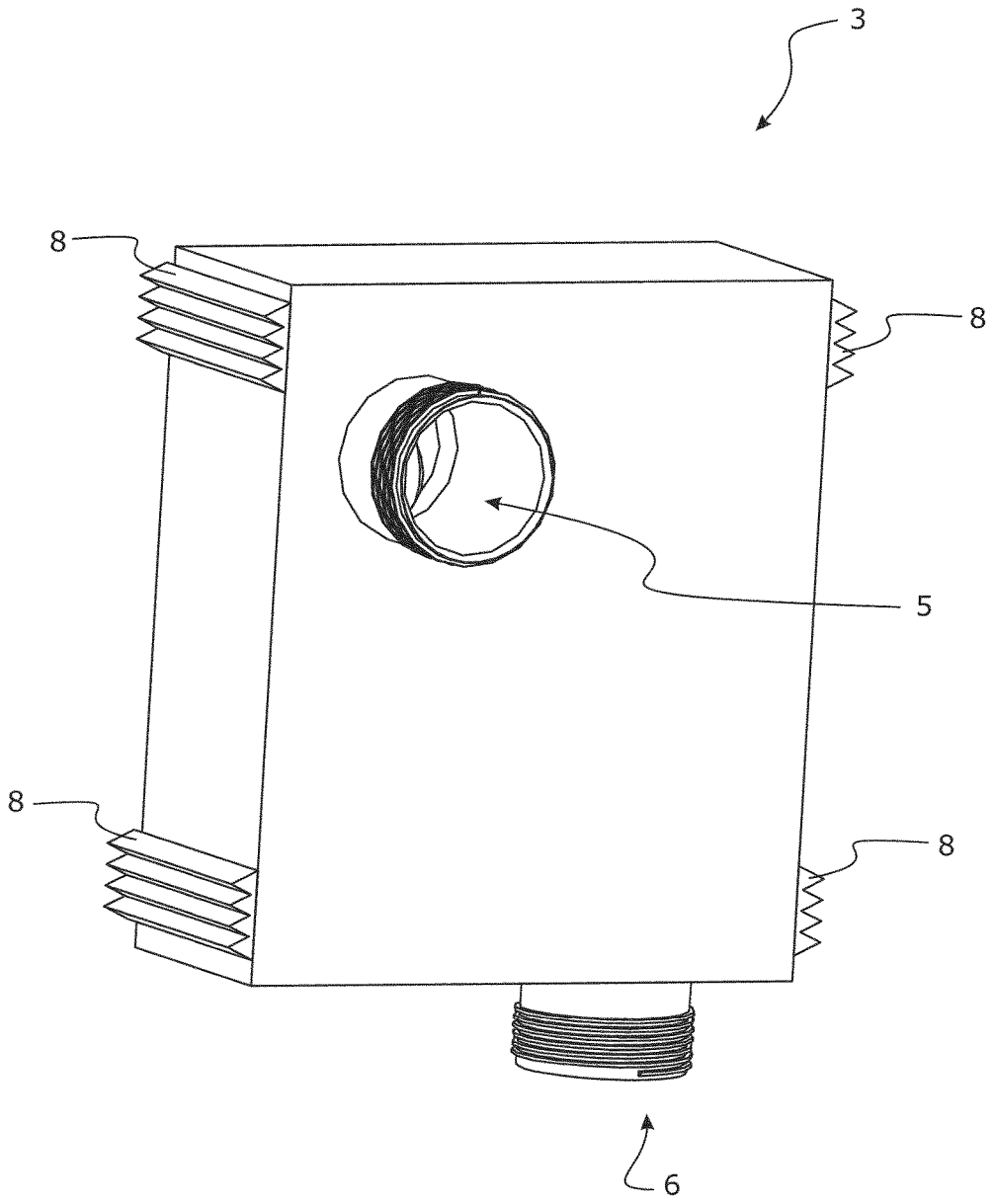
FIG. 5A illustrates a perspective view of one embodiment of a second housing portion comprising a plumbing configuration or arrangement before installation into a first housing portion.

FIG. 5A illustrates a second housing portion 3 before installation into the cavity space 17 and engagement of the receptive co-locating devices 8. Co-locating devices 8 are shown as a series of teeth which can co-operatively engage with respective teeth (or the male projections and female recesses) of those provided on an internal side wall surface of the first housing portion.

Figure 5B:
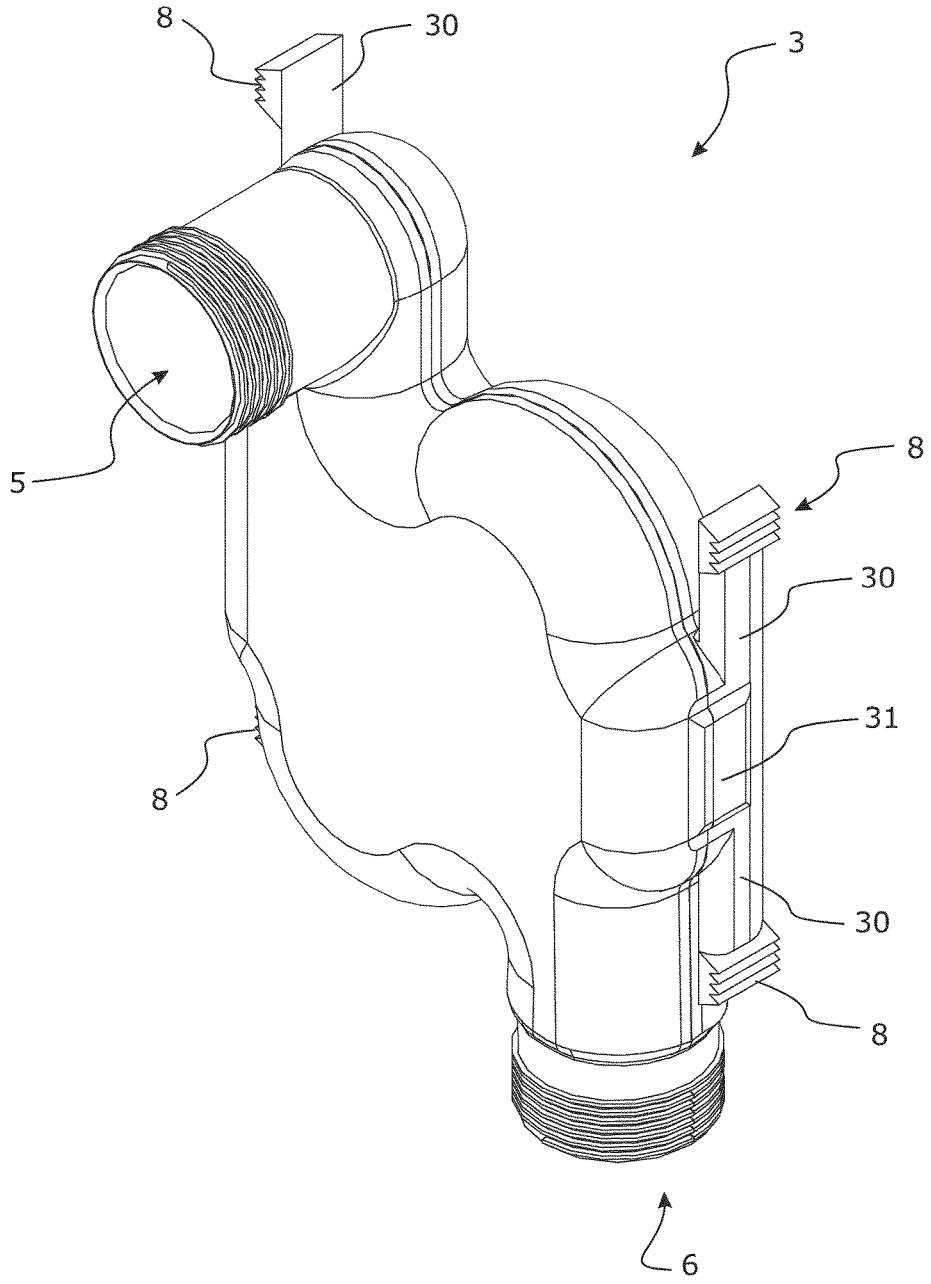
FIG. 5B illustrates a perspective view of an alternative embodiment of a second housing portion comprising a plumbing configuration or arrangement before installation into a first housing portion.
Figure 5C:
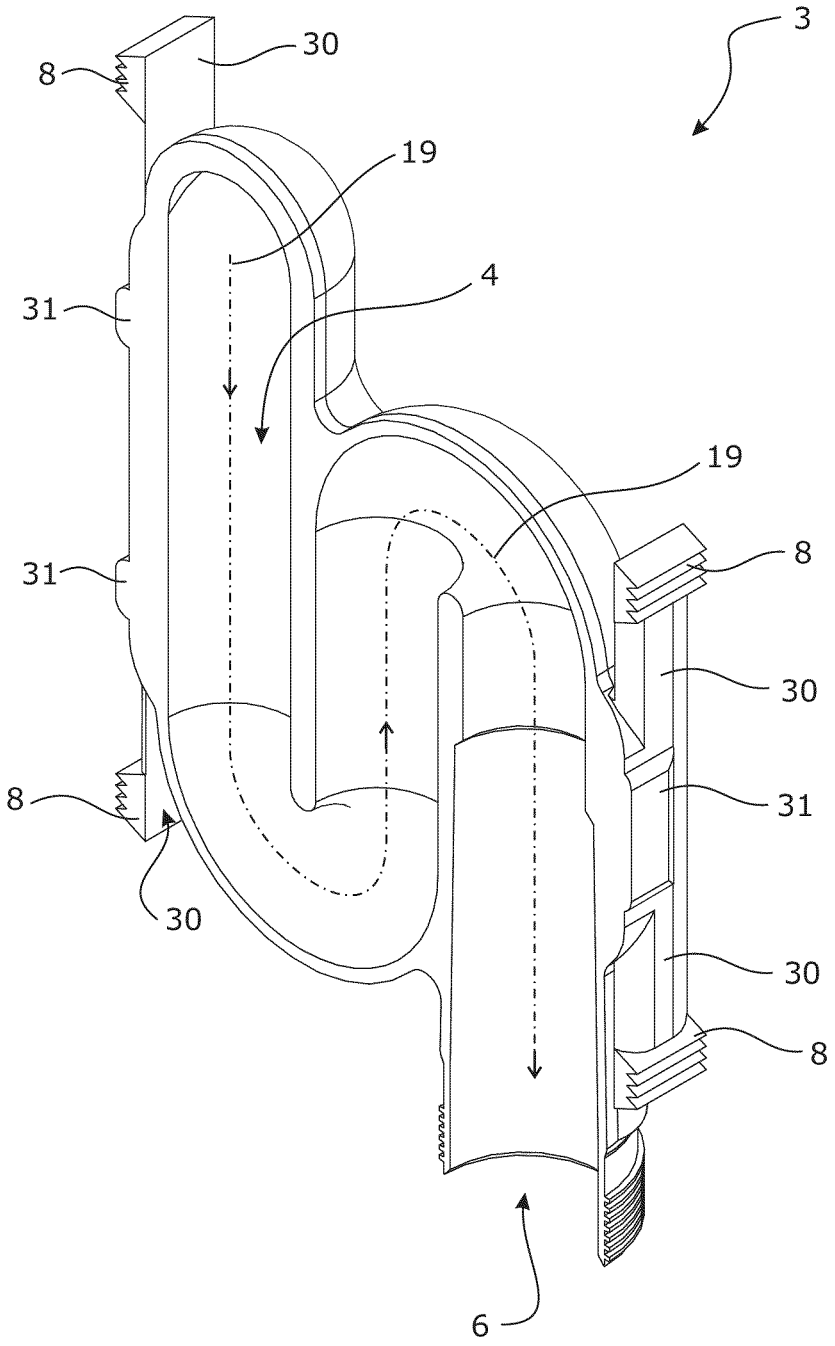
FIG. 5C is a cross-section through the embodiment of FIG. 5B.
Figure 5D:
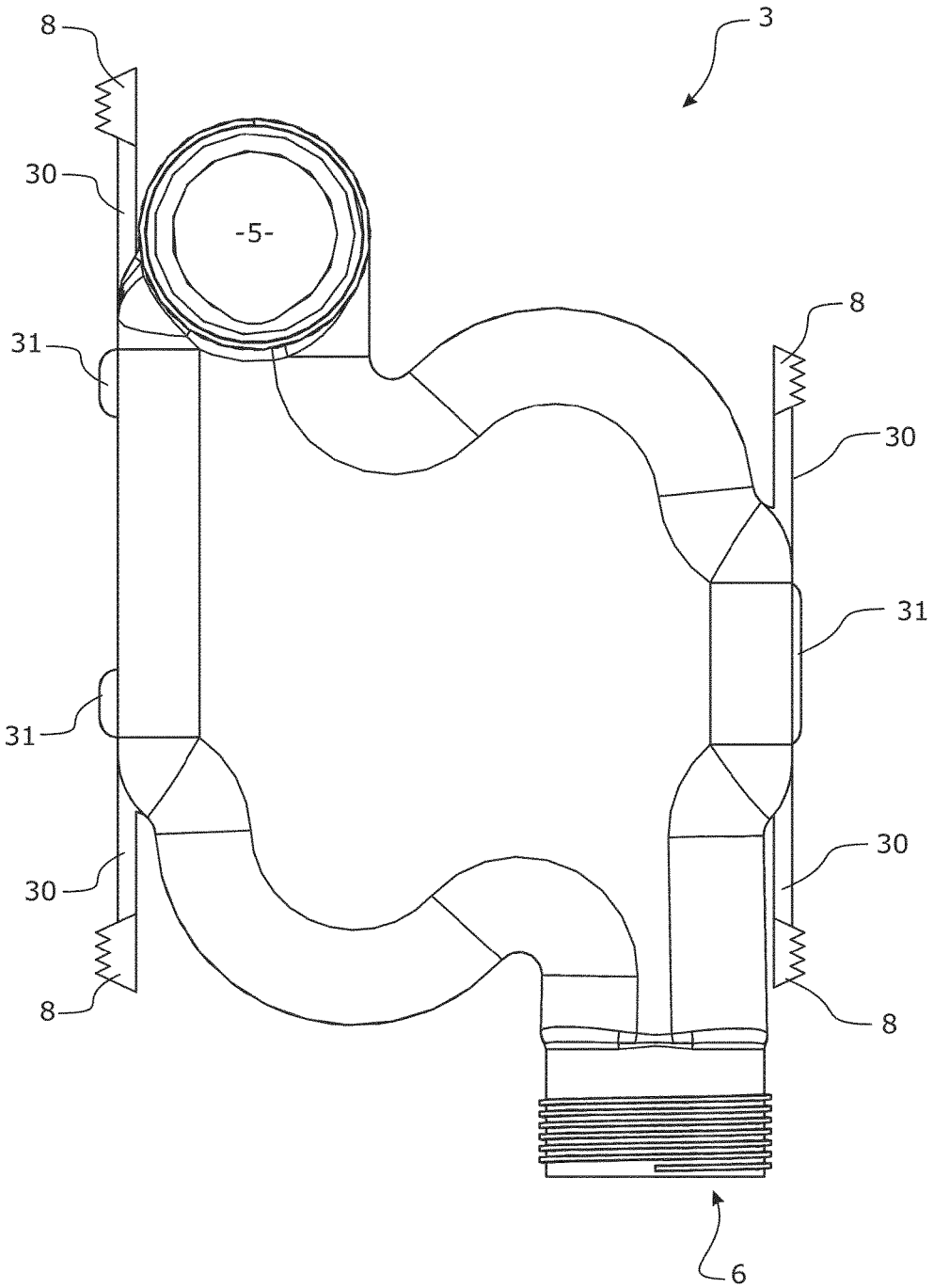
FIG. 5D is a front-side view of the embodiment of FIG. 5B.
Figure 5E:
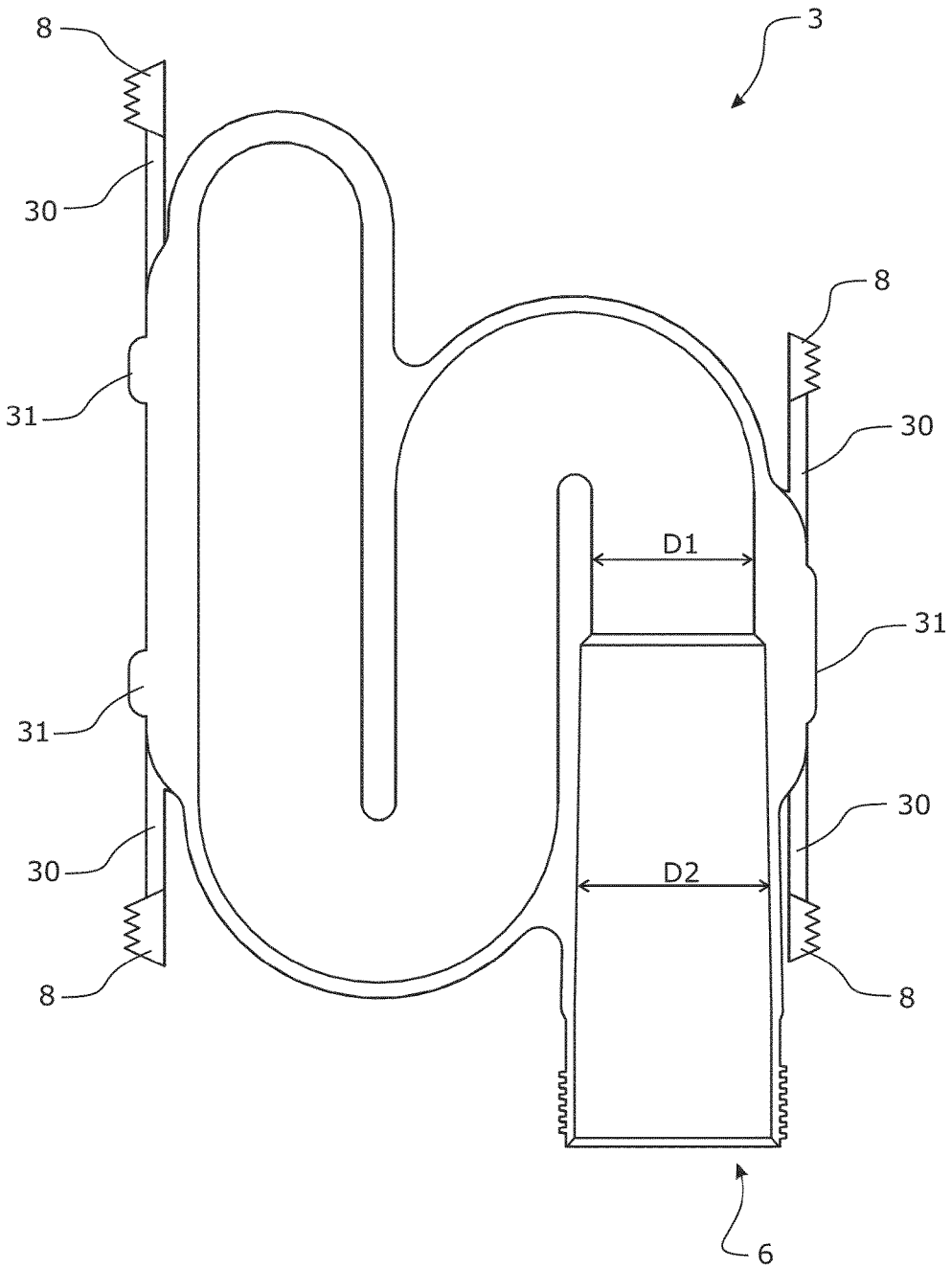
FIG. 5E is a cross-section through the embodiment of FIG. 5D.

FIG. 5B-G illustrate further alternative embodiments of a second housing portion 3. Note the off-set co-locating devices 8. A first set of co-locating devices 8 may be provided on a first side of the second housing portion, each one of the set of co-locating devices space apart or supported at an end or along at least a portion of an arm 30. The co-locating device at an end of the arms 30 may be able to be deflected by a user so as to de-establish an engagement of the respective co-locating devices from the second housing portion from the first housing portion. This may allow for a sliding or other position adjustment of the second housing portion 3 relative to the first housing portion 2 without the need to remove the second housing 3 from the cavity space 17 entirely. FIG. 5B also shows bump stops 31 which act to additionally co-operate or engage with a surface of the co-locating devices 8 on a side wall of the first housing portion 2, thereby helping provide for an alignment of the second housing portion 3 correctly with the co-locating devices.

The co-locating devices 8 of the first housing portion 2 may extend substantially the depth of the internal side walls, whilst the co-locating devices 8 of the second housing portion 8 and the actual depth of the second housing portion 3 itself may be less that the depth of the first housing portion 2. In this manner, the second housing portion 3 may be adjusted in its lateral (or depth-wise) positioning relative to the first housing portion 2. It is for this reason that the outlet 7 may be configured to be suitably shaped to allow for a variety of second housing portion 3 positions within the first housing portion 2.

Figure 5F:
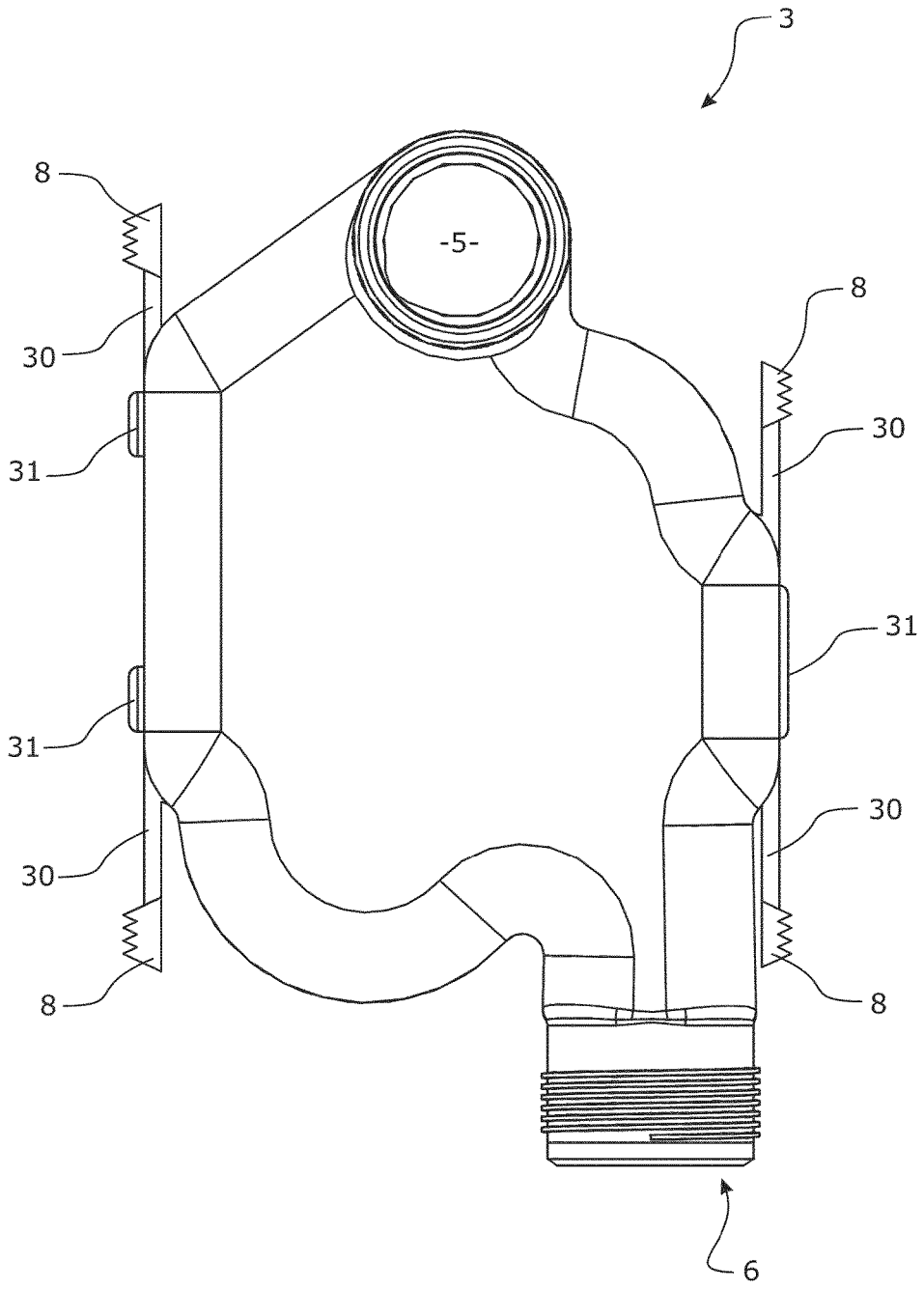
FIG. 5F is front-side view of another embodiment of a second housing portion comprising a plumbing configuration.
Figure 5G:
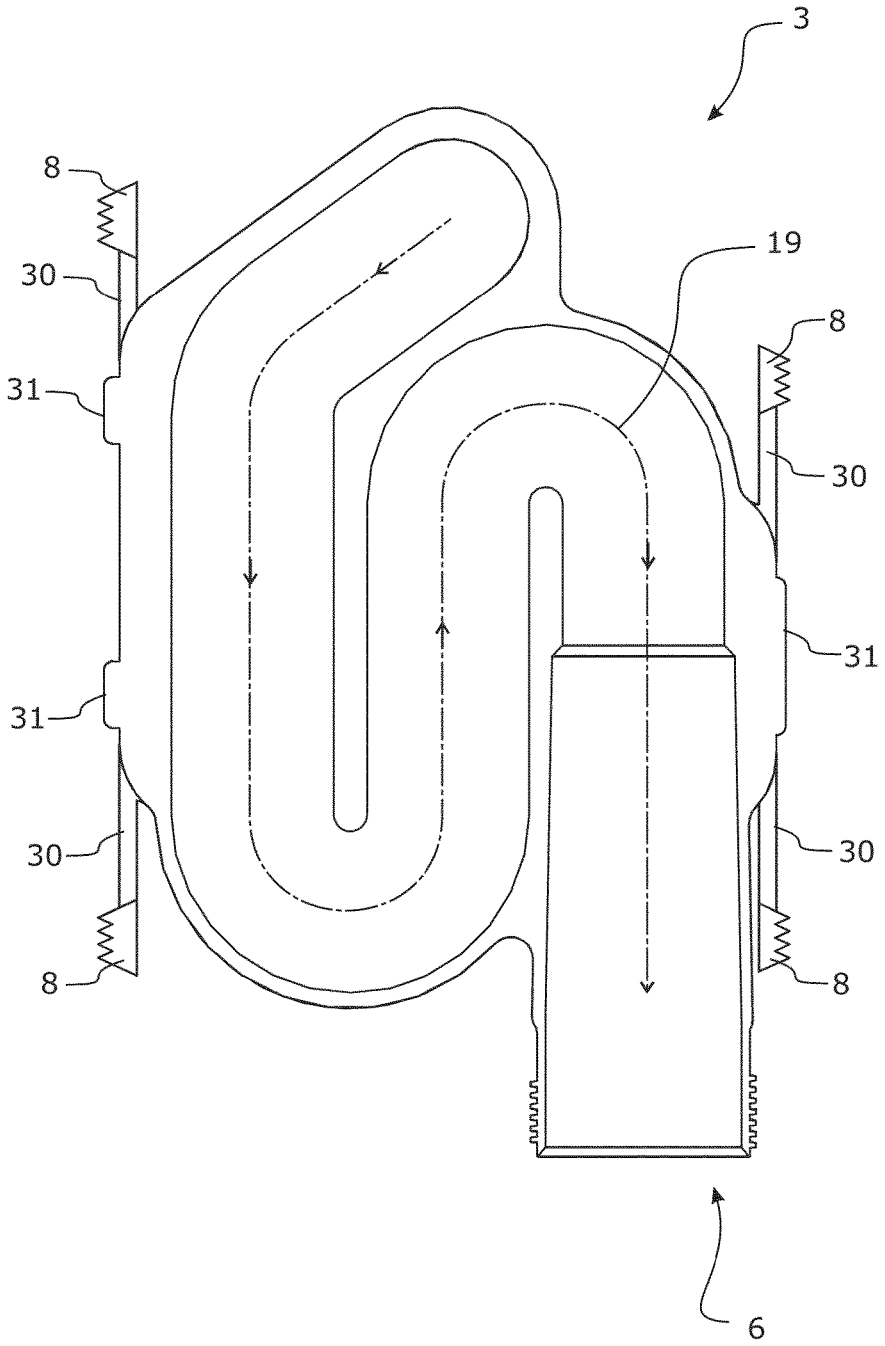
FIG. 5G is a cross-section through the embodiment of FIG. 5F.

Additionally, note that the inlet 5 to the plumbing configuration 4 of the second housing portion 3 shown in FIG. 5F-G is substantially centrally located with respect the housing portion 3 itself.

Figure 6A:
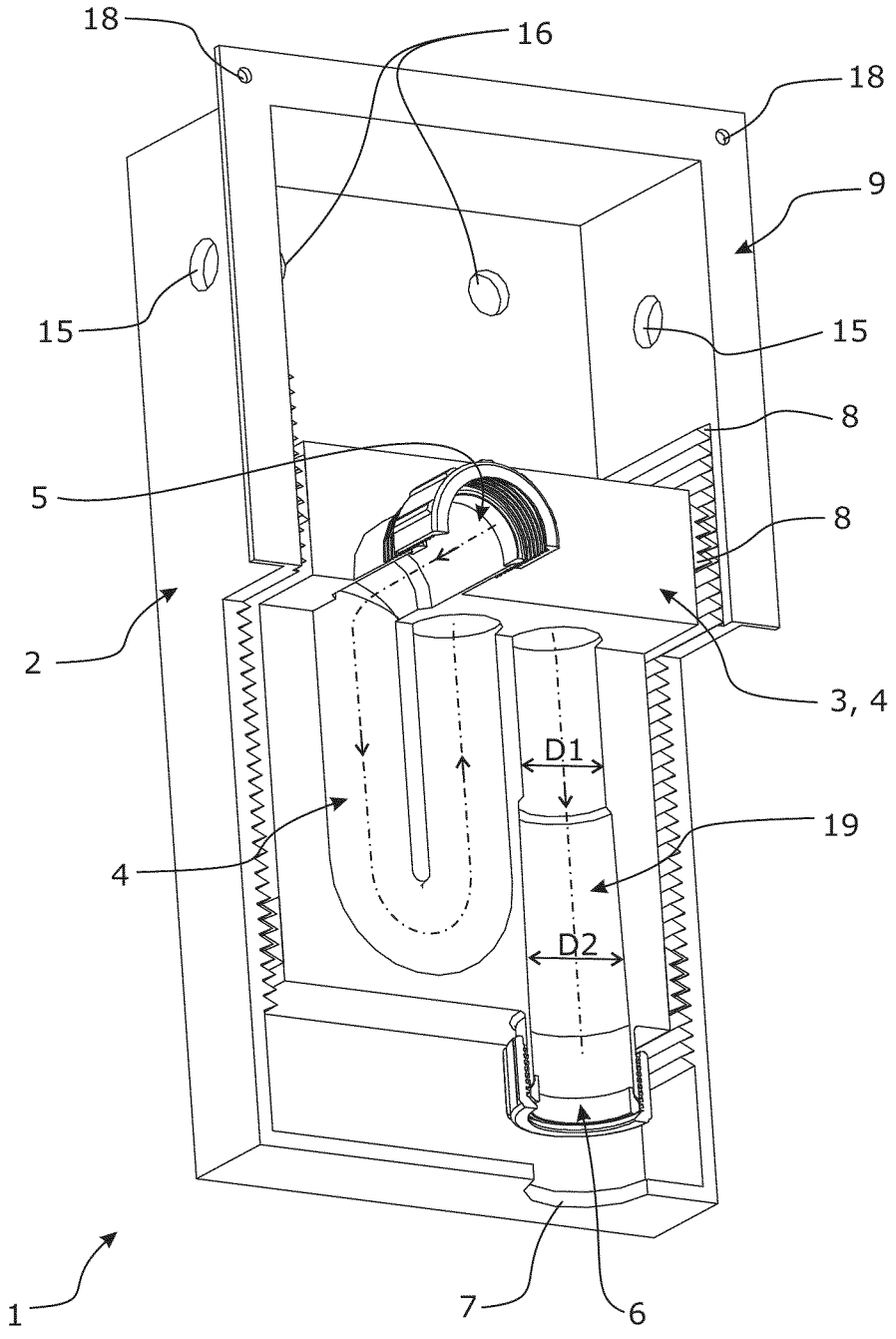
FIG. 6A illustrates a partial section view through a lower part of part of one embodiment of a second housing portion comprising a plumbing configuration or arrangement installed in the cavity space of a first housing portion.
Figure 6B:
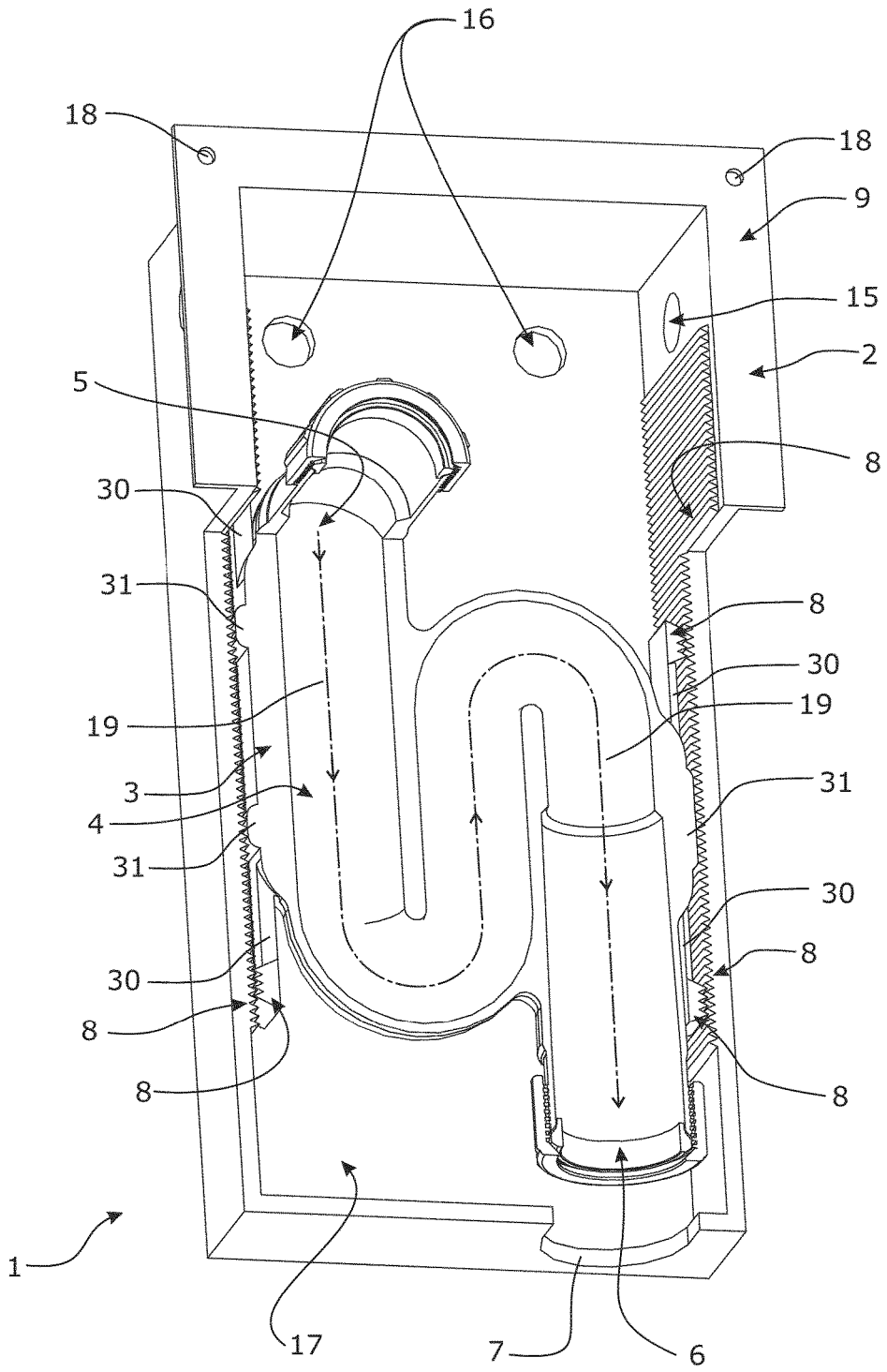
FIG. 6B illustrates a partial section view through a lower part of another embodiment of a second housing portion comprising a plumbing configuration for arrangement installed therein.
Figure 6C:
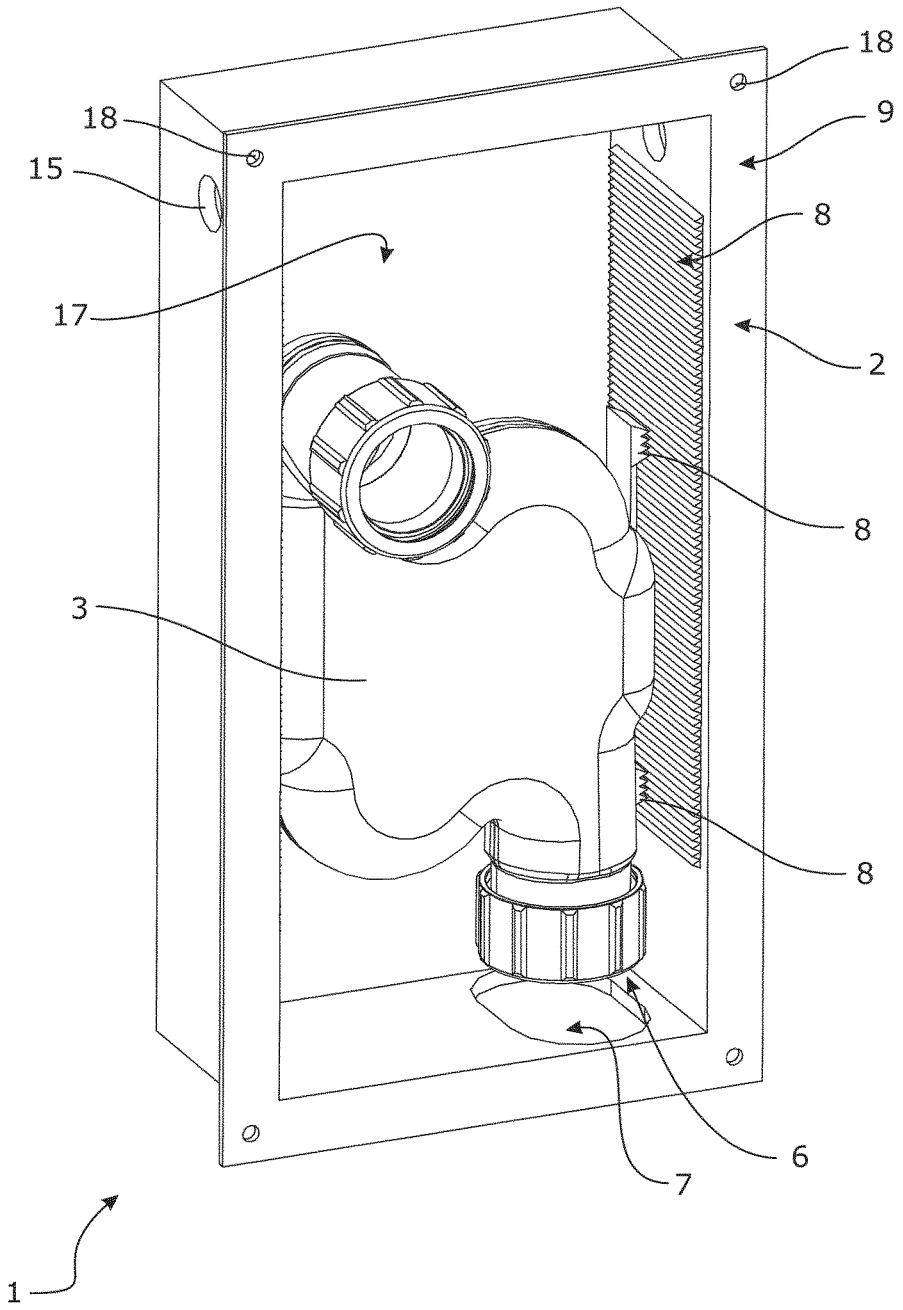
FIG. 6C illustrates a perspective view of another embodiment of a second housing portion installed in a first housing portion.
Figure 6D:
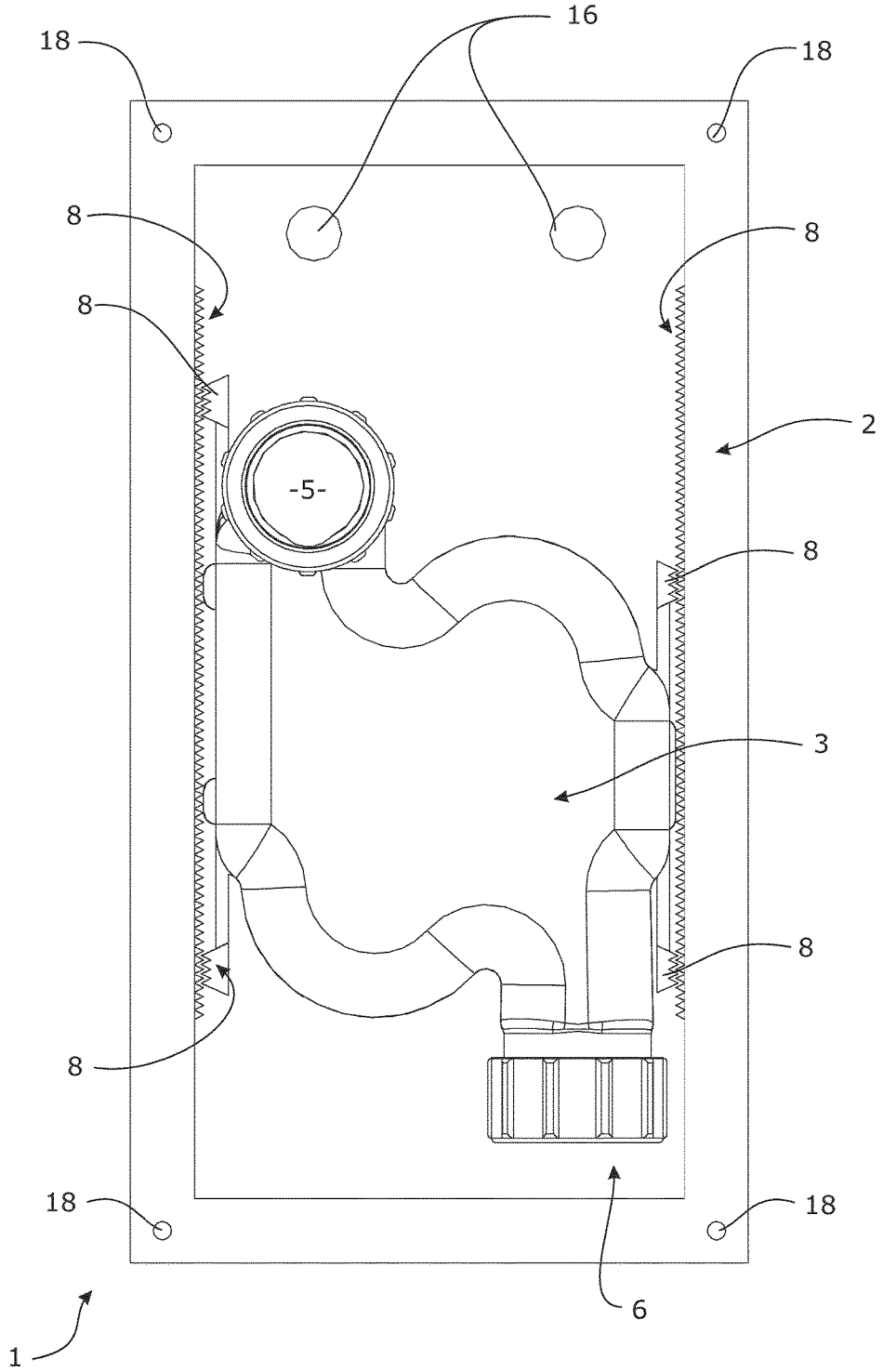
FIG. 6D is a front-side view of the embodiment of FIG. 6C.
Figure 6E:
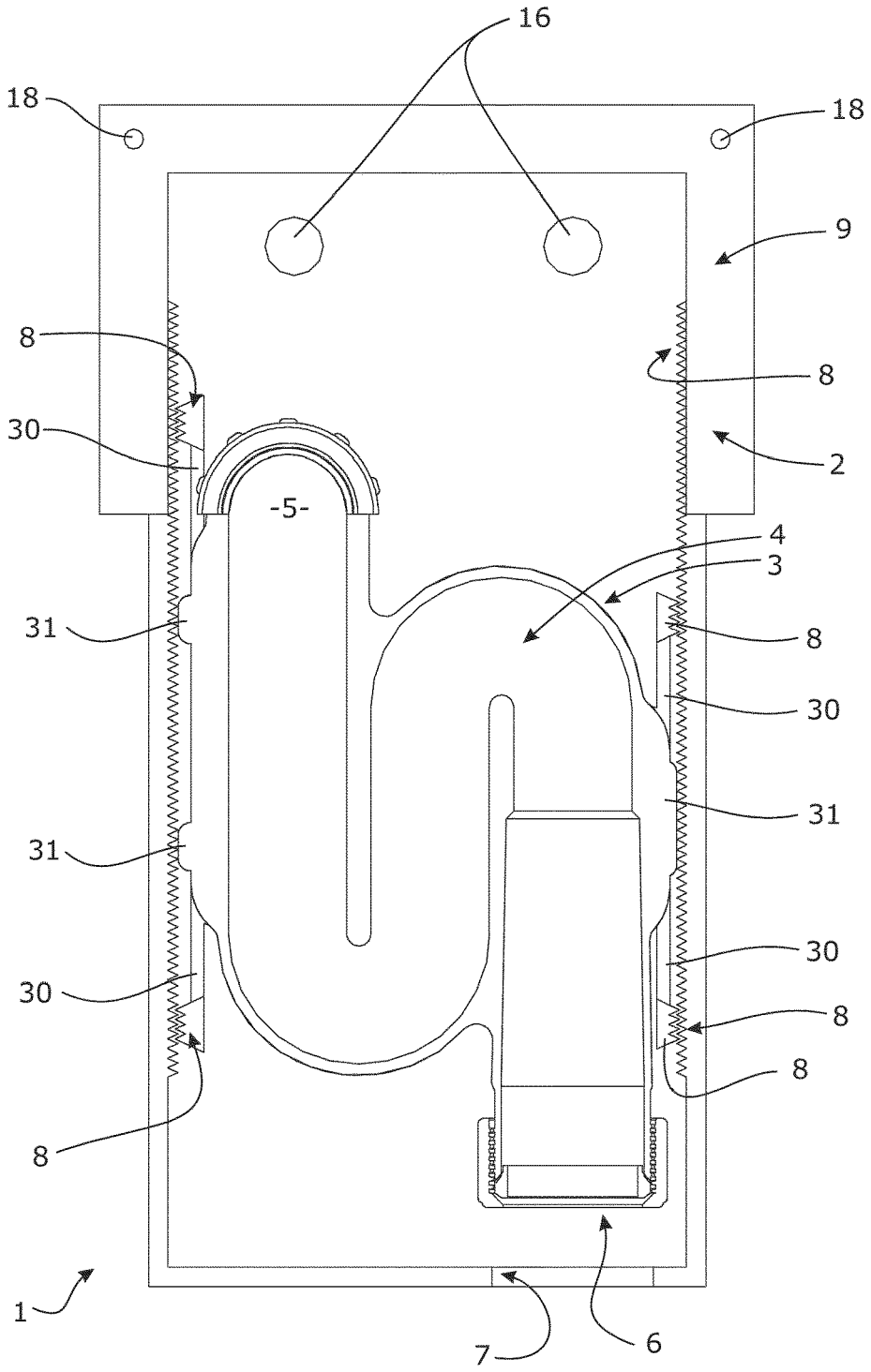
FIG. 6E is a partial section view through a lower part of the embodiment of FIG. 6D.
Figure 6F:
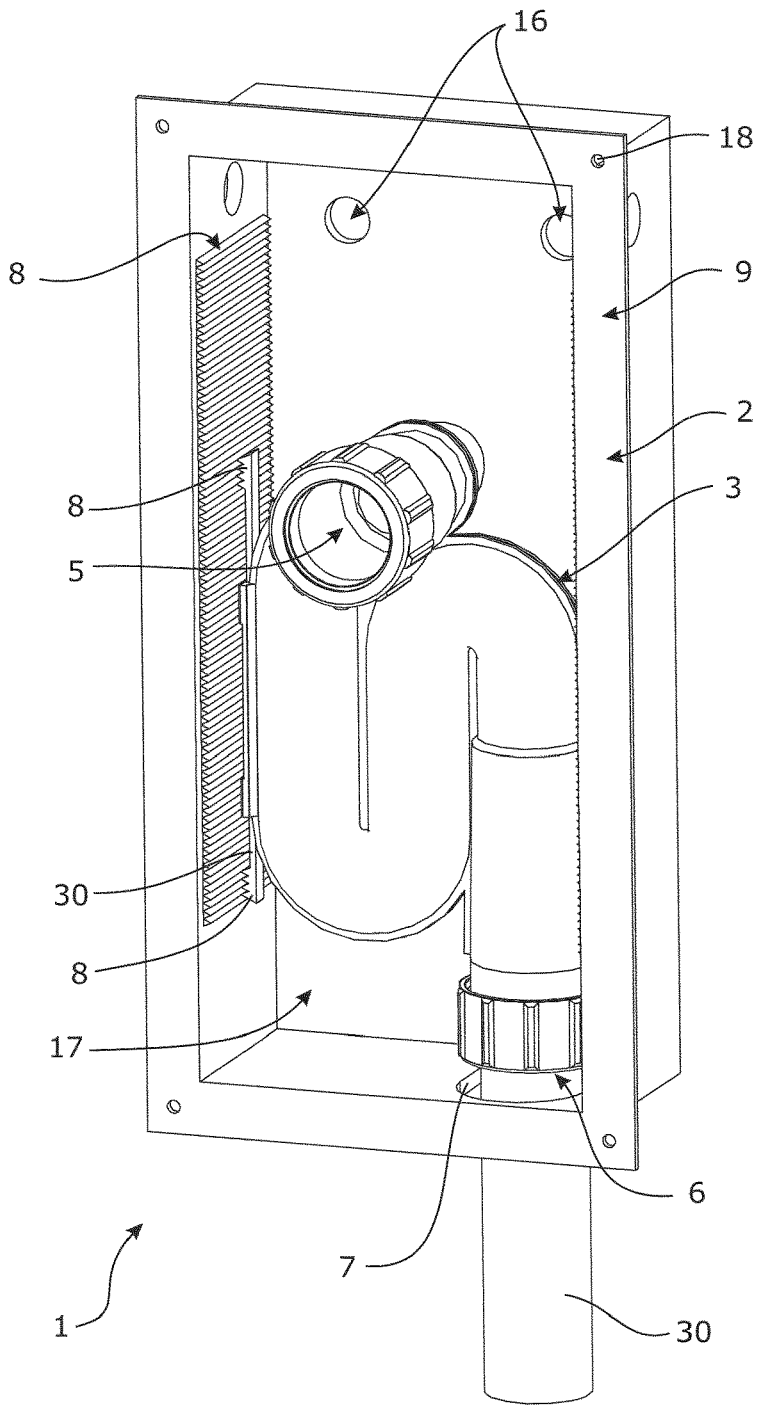
FIG. 6F is a perspective view of the second housing portion of FIG. 5F-G installed within a first housing portion, when the second housing portion is positioned in a lower or more downward position relative to the first housing portion.
Figure 6G:
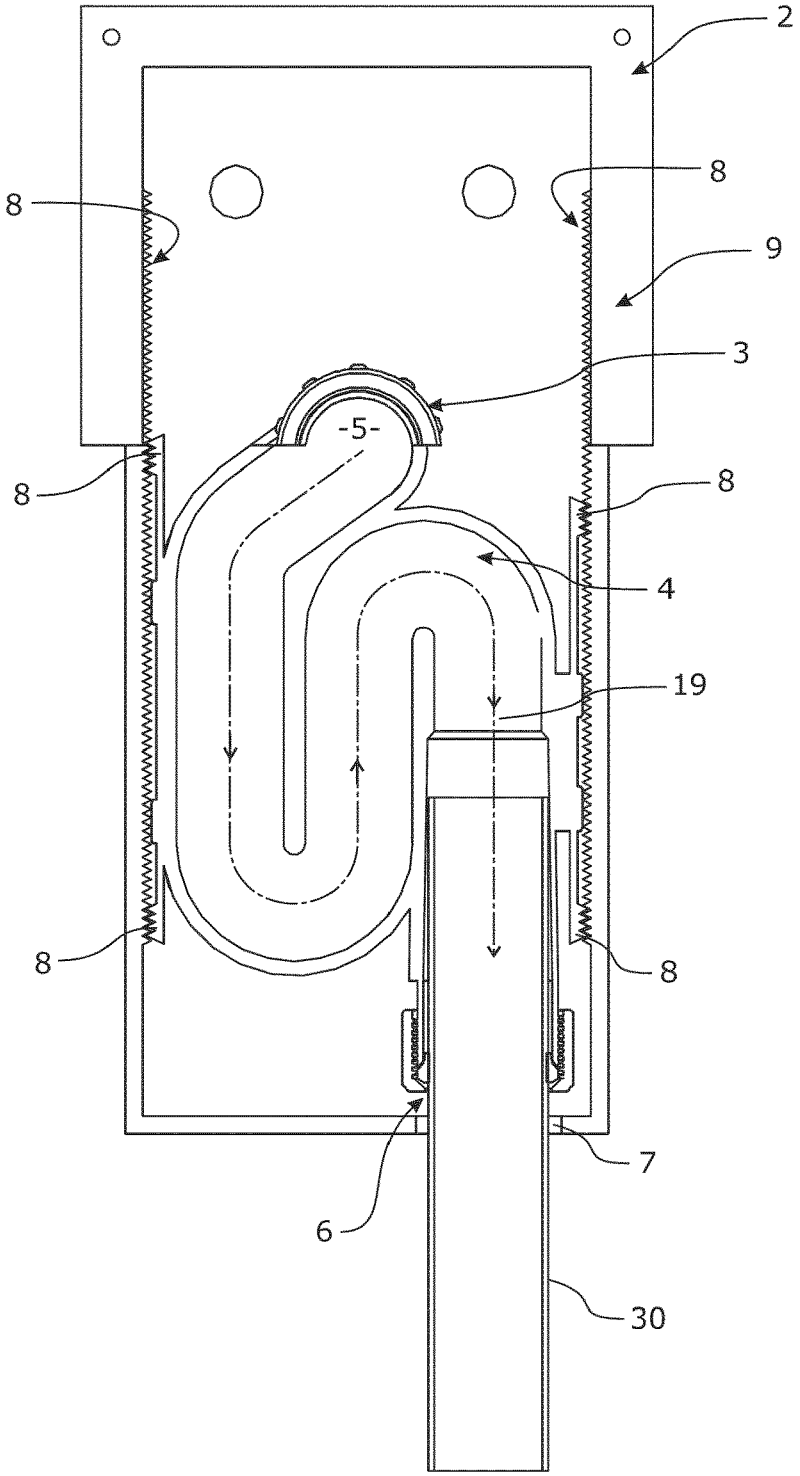
FIG. 6G is a partial section view though a lower part of the embodiment of FIG. 6F.

FIG. 6A illustrates a partial section view of the embodiment first shown of FIG. 1. Note the fluid flow pathway 19 and the relatively larger internal diameter D2 compared to the internal diameter D1 of the plumbing arrangement more upstream from the outlet 6. The larger diameter D2 allows for receipt of a length of conduit or pipe 30 which may be sleeved within to then be connected through the enclosure outlet 7. By provision of a length of the plumbing configuration having such a larger diameter D2, the sleeved conduit or pipe may extend fully all the way up to a maximum sleeved capability, or may be sleeved only partially with the D2 diameter. In this manner, plumbing configuration allows for the conduit or pipe 30 to remain fluidly connected to or accommodated within the plumbing configuration, even if the plumbing configuration or second housing portion 3 is re-positioned upwards or downwards within the enclosure or relative to a first housing portion 2 (or relative to the conduit or pipe 30)

The larger diameter D2 portion and length of the plumbing configuration 4 allows for receipt of the conduit or pipe 30 into the bottom of the plumbing configuration, for example bottom or outlet from an S-shaped or P-shaped trap.

The larger diameter D2 portion and length of the plumbing configuration performs as a socket section of a predetermined length to facilitate a continued fluid connection of the pipe or conduit 30 with the plumbing configuration, even when the outlet 6 (and thereby the plumbing configuration or second housing portion 3) is re-positioned longitudinally relate to an encasement 1 or a first housing portion 2.

An extensible or expandable conduit or pipe, such as for example a concertina type conduit or pipe may alternatively be provided in connection with the outlet 6 of the plumbing configuration to, again, allow for a re-positioning of the plumbing configuration 4 or the second housing portion 3 relative to the encasement 1 or a first housing portion 2, yet maintaining a fluid connection.

In yet a further embodiment, a telescopic or telescoping conduit or pipe may be connected to the outlet 6 so as to allow for the relative re-positioning longitudinally of the outlet 6 and the plumbing configuration 4 or second housing portion 3 upwards and downwards.

FIG. 6B-I illustrate other an alternative embodiments, in which the second housing portion 3 of FIGS. 5B-G are provided in an installed portion and the various views thereof.

Figure 6H:
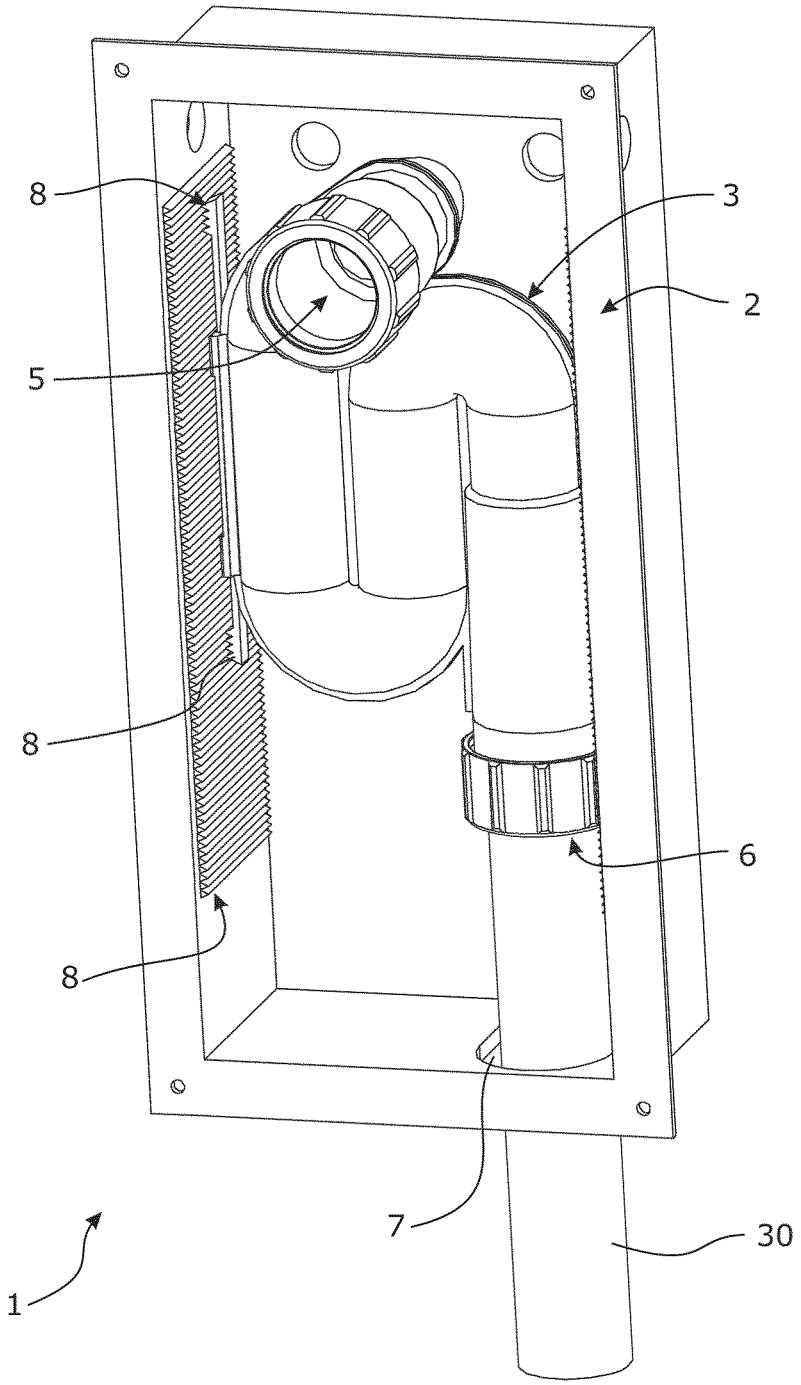
FIG. 6H is a perspective view of the second housing portion of FIG. 5F-G installed within a first housing portion, when the second housing portion is positioned in an upper or more upward position relative to the first housing portion.
Figure 6I:
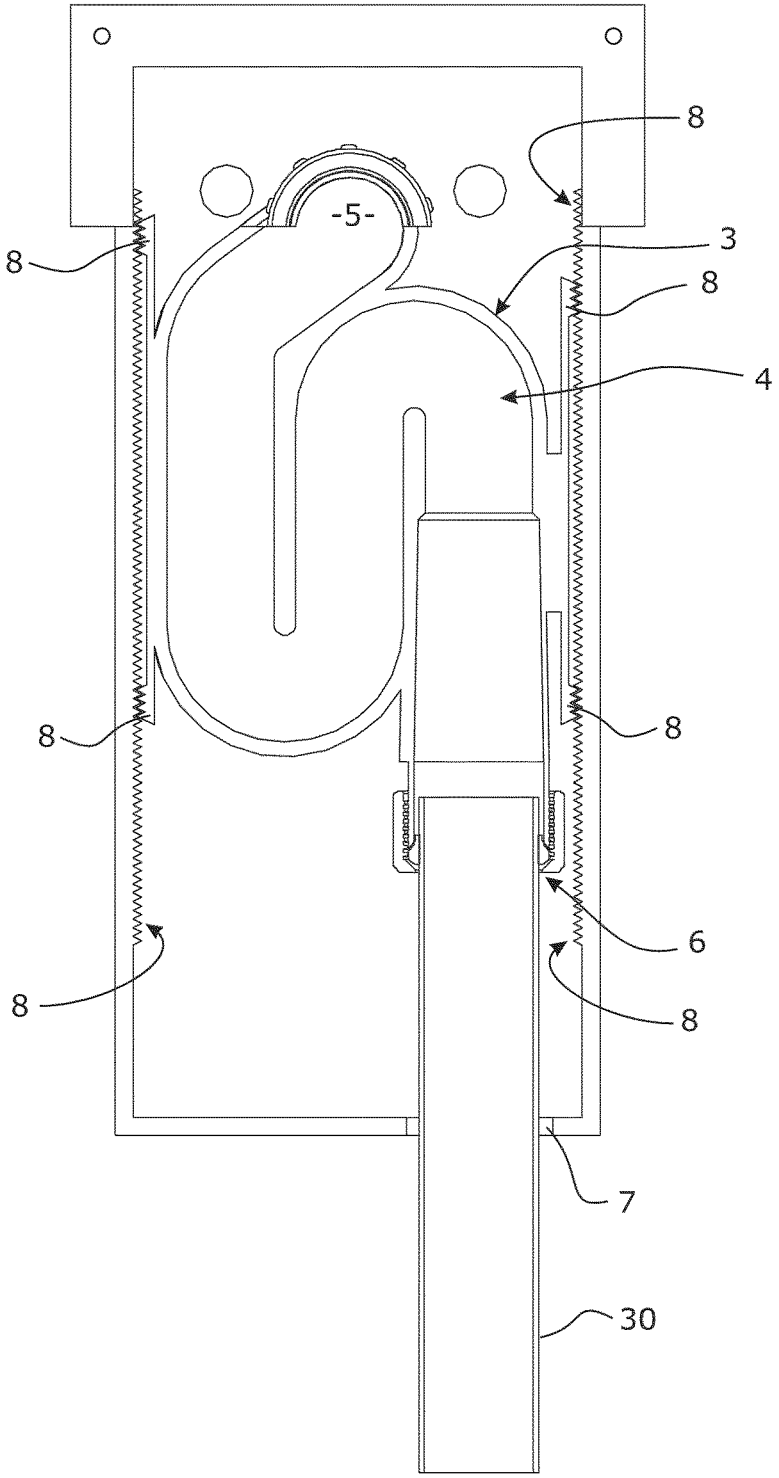
FIG. 6I is a partial section view though a lower part of the embodiment of FIG. 6H.

FIGS. 6B-G illustrate embodiments where the second housing portion is positioned by the co-locating devices 8 in a lower or more downward position relative to the first housing portion. In comparison, FIGS. 6H-I illustrate an embodiment in which the second housing portion has been positioned in a more upward or higher location relative to the first housing portion. These variations show examples of how the plumbing configuration may be re-positioned, and yet the conduit or pipe 30 for connection to the outlet 6 may be maintained.

In still a further embodiment, it will be appreciated the co-locating devices 8 may be provisioned on an exterior surface of a body comprising a plumbing configuration, for example the body being the housing portion 20 shown in FIG. 7A.

Such co-locating devices may be configured so that a first set of respective co-locating devices 8 interacting between a first housing portion 2 and a second housing portion 3 allow for a relatively easier path of travel or adjustment in a first direction or a preferred set of directions, yet which prevents travel or adjustment of each such housing portion with respect to each other in another direction or another set of directions.

Those co-locating devices 8 that are positioned relatively higher up on the housing portion 20 (i.e. on a left and a right side of the portion 20) may be shaped so as to preferentially engage with a respective set of co-locating devices provisioned on another housing portion into which the housing portion 20 may be received. Similarly, where a preferential engagement of co-locating devices 8 is provided, there can be a preferential direction or method for disengaging such co-locating devices from each other. In this manner, a set of more upward co-locating devices 8 on, for example housing portion 20, may preferentially engage to stop the housing portion 20 from moving downwards in any enclosure, whilst a set or more downwardly positioned co-locating devices may preferentially engage to stop the housing portion 30 from moving upwards in any enclosure (or vice-versa or combinations of these).

Without being limited in scope as to the materials for which the encasement or its parts may be made, particularly preferred may be one or more of the following: PVC, ABS, nylon, Polycarbonate, PP, PE, PET, PU, metals including stainless steel, galvanised steel, copper, brass.

The respective parts of the encasement 1, or the whole assembly, may be blow-moulded or injection moulded or die-cast moulded, or formed using other known techniques for shaping such materials.

The encasement 1 is preferably mounted inside of a wall cavity. In such embodiments, the encasement 1 is formed to be of a depth so as to fit within the wall cavity, and/or of a width so as to be mounted between framing members (such as supporting studs or other framing members) of a wall. Alternatively, the encasement 1 can be mountable within a vanity cupboard or a utility cupboard or kitchen cupboard.

The encasement 1 may provide for a covering or otherwise concealed or protected plumbing configuration, for example the first housing portion 2 can provide for an additional shell or outer housing around the plumbing configuration, for example provided by the second housing portion which is received within the cavity space 17 of the first housing portion (together defining the encasement 1). In this way, hot (or cold) fluids passing through the plumbing configuration and the heat (or chill) they transfer to the plumbing configuration conduit or second housing portion 3, is protected from coming into contact with a person who may otherwise be in close proximity to the encasement 1. This may have particular application to under-bench or under-sink type situations where the plumbing configuration is to be concealed and protected from intrusion or contact by a person (e.g. where the person may be in a wheel-chair and their legs may accidentally contact an exposed traditional plumbing conduit which becomes hot or cold due to the fluid passing therethrough—such hot or cold is prevented from touching the person).

As such, it will be now realised the encasement 1 additionally provides for a concealed plumbing configuration or arrangement.

The encasement 1 houses therein one or more water supply outlets, for example a hot and/or a cold water supply outlet.

One or more removable plugs or pop-out sections may be removed from one or more wall sections (such as side walls or bottom wall (or floor) of the encasement to facilitate an access-point for providing a fluid connection to or from a conduit to be housed within the encasement or for accessing inlets or outlets from the plumbing configuration or 4.

It will also be appreciated a protective cover or lid or plate or additional sheet, such as a face plate, such as that identified as item 31 may be provided to connect or engage with the enclosure or first housing portion, such as the perimeter, so as to fully conceal the cavity space 17 and the housing portions which may be contained therein, such as a first housing portion 2 and a second housing portion 3.

Such a cover or lid or plate or additional sheet (not shown) may incorporate slots or apertures as necessary so as to accommodate the ability for the first housing portion to be adjusted in position or location within the cavity space 17, whilst maintaining a substantially covered cavity space 17. Alternatively, it will be appreciated such a cover or lid etc can be sectioned or cut by an installer so as to provide an aperture through which a fluid connection may be made to the inlet 5 of the plumbing configuration 4. In other words, a custom type face plate can be configured at the time of assembly. Alternatively, a series of pre-formed covers or lids etc can be provided with differently located apertures.

In still a further embodiment, the cover or lid etc may be a face plate providing for protection, either as vandal-proof or tamper-proof or as a dust or liquid seals or for aesthetic reasons to conceal the cavity space 17. Where necessary, security type fasteners may be used to prevent unauthorised access to the encasement and the cavity space 17 and contents therein.

Protective lids or covers etc may find particular use in situations as hospitals or public facilities where a securely concealed enclosure is desired. Stainless steel is a particularly preferred material for such protective lids or covers in such situations (for example to assist with ease of cleaning and for corrosion preventions)—but not necessarily limited to this alone.

FIG. 8 illustrates one embodiment of a cover or lid etc labelled as item 31. The aperture through the cover or lid 31 is configured to allow a fitting for connection to the inlet 5 to be made. However, it will be appreciated the cover or lid 31 may be provided with alternative systems to allow for a fluid connection to be made to the inlet 5 when the plumbing configuration or second housing portion is re-positioned relative to the first housing portion.

FIGS. 9A-B illustrate an encasement 1 in which a conduit or pipe 32 is fluidly connected to the inlet 5 of the plumbing configuration.

In still further embodiments, there is an encasement (or utility housing) for a plumbing configuration that comprises a formed enclosure, the enclosure being mountable to a wall or a part of a wall or a support structure. At least a part of the enclosure comprises a plumbing configuration configured to receive, or be in fluid communication with, a flow of fluid and to channel the received flow of fluid to an outlet from the plumbing configuration or the enclosure. In such an embodiment, such an encasement may include one or a plurality of flanges 9 that can extend from the enclosure so as provide for one or a plurality of fastening points for fixing or mounting the enclosure to a wall or a part of a wall or another support structure. Such flanges 9 preferably extend in a manner from a rear surface or rear face of the enclosure so as to provide a stand-off positioning of this encasement from the surface or structure to which it is to be mounted or affixed or fastened. See for example FIGS. 7A-7D illustrating such an encasement.

In yet another embodiment, there may be provided a housing portion 20 comprising a plumbing configuration 21 that is formed, or otherwise moulded (such as blow-moulded, but not limited to this) in which a labyrinth or otherwise serpentine type fluid flow path, for example as identified by dashed fluid flow path item 19, and which is configured to facilitate a fluid seal of a predetermined weir height, wherein the plumbing configuration 21 includes at least one integrally formed or moulded flange 9 through which a fastener or fixing (e.g. a penetrative fastener such as a nail or a screw) may be secured for fastening or securing the housing portion 20 to a support structure (for example, but not limited to, a wall or a part of a wall or another support structure). Such a housing portion 20 may be directly affixed to a wall or a part of a wall or support structure, or may be more permanently mounted or fixed in place when placed within another housing, such as within a first housing portion (not shown in relation to FIGS. 7A-D, but which would be similar to the arrangement of FIG. 1, but without co-locating devices 8).

According to the embodiment described above, the housing portion 20 is a body which substantially conceals the plumbing configuration or which provides a sub-housing through which the plumbing configuration is internally formed therethrough. The fluid flow path 19 extending from between an inlet 5 to the plumbing configuration 21 passing through the housing portion 20 advantageously travels or is located substantially in the same plane, or an in-line plane, when travelling from between the inlet 5 to the plumbing configuration to the outlet 6 from the plumbing configuration 21.

In this respect, and as noted for example in FIG. 6A-E, as well as FIG. 7A-D, an in-line or same plane fluid flow path, or same plane plumbing configuration can facilitate for relatively compact, or shallow depth of a plumbing configuration to allow for an in-wall or relatively shallow plumbing configuration which still provides for a suitable labyrinth or serpentine or trap type configuration to enable a fluid seal.

The (or an) inlet 5 to the plumbing configuration 21 can be in a plane substantially orthogonal, or different, to the plane of the fluid flow path 19 that travels from between the inlet 5 to the plumbing configuration to the outlet 6 from the plumbing configuration.

The outlet 6 from the plumbing configuration 21 can be in the same or a different plane to the plane of the fluid flow path 19 that travels from between the inlet 5 to the plumbing configuration to the outlet 6 from the plumbing configuration.

Optionally, but preferably, with each of the embodiments described herein, the internal diameter D2 of the plumbing configuration extending from the outlet 6 of the plumbing configuration 4 to a predetermined distance upstream is of a greater internal diameter than of the internal diameter D1 of the plumbing configuration still more upstream. For example, for a predetermined length of the fluid flow pathway 19 of the plumbing configuration 4 adjacent to and immediately upstream from the outlet 6 from the plumbing configuration 4 there is a larger internal diameter D2 than the internal diameter D1 of the plumbing configuration still further upstream.

With respect to the embodiments described herein, In this manner, starting from the outlet 6 from the plumbing configuration 6, and for a particular length of the plumbing configuration 4, immediately upstream from the outlet 6 the plumbing configuration is internally configured to receive a conduit or pipe therein without interrupting or providing an interruption to the fluid flow pathway of fluid, or passage for fluid, being discharged from the plumbing configuration.

In respect the of the larger diameter D2 length of the plumbing configuration, reference is made to the aforementioned description. Such a larger diameter D2 provisions for a continued fluid connection of a pipe or conduit 30 with the plumbing configuration and its outlet 6, when there is an upwards or downwards re-positioning of the plumbing configuration 4 or second housing portion 3.

Still further, and with respect to the embodiments described herein, the outlet 7 from the encasement (or a first housing portion 2) is configured to accommodate a lateral positioning of a second housing portion 3 with respect to the first housing portion 2, and the associated relative lateral movement or lateral re-positioning of the outlet 6 from the plumbing configuration 4. The foregoing description of the invention includes preferred forms thereof. Modifications may be made thereto without departing from the scope of the invention.

The invention claimed is:

1. An encasement for a plumbing configuration, comprising:

a formed enclosure, the enclosure being mountable to a wall or a part of a wall or a support structure, the formed enclosure being a first housing portion, the first housing portion providing for a cavity space, and wherein a second housing portion is receivable by, or co-locatable with, the first housing portion, the second housing portion being receivable or co-locatable substantially within the cavity space of the first housing portion, and wherein at least a part of the second housing portion comprises a plumbing configuration configured to receive via at least one inlet, or be in fluid communication with, a flow of fluid and to channel the received flow of fluid to an outlet from the plumbing configuration, wherein the first housing portion and the second housing portion each comprise one or a series of co-locating devices for co-locating the position of the second housing portion substantially within the cavity space of the first housing portion, wherein the first housing portion includes a first side wall and a second side wall substantially parallel to the first side wall, wherein the one or a series of co-locating devices of the first housing portion are disposed on at least one of a first inner surface of the first side wall or a second inner surface of the second side wall, wherein the second housing portion, and the plumbing configuration of which the second housing portion is at least in part comprised, is vertically adjustable between a plurality of fixed vertical positions by re-positioning the engagement of the one or a series of co-locating devices of the second housing portion with the one or a series of co-locating devices of the first housing portion, and wherein each of the one or a series of co-locating devices of the second housing portion is at least partially contained within the first housing portion in each of the plurality of fixed vertical positions.

2. The encasement as claimed in claim 1, wherein the plumbing configuration or the second housing portion is: provided in-situ with, formed as an integral part of, or moulded as a part of, a first housing portion or a second housing portion.

3. The encasement as claimed in claim 1, wherein the plumbing configuration is removable or may be disassociated from the enclosure or from an associated first housing portion or associated second housing portion.

4. The encasement as claimed in claim 1, wherein the plumbing configuration is a labyrinth or serpentine arrangement pre-configured to provide for a fluid seal having a predetermined fluid weir height.

5. The encasement as claimed in claim 1, wherein the plumbing configuration is one of:

a p-shaped trap, or an s-shaped trap.

6. The encasement as claimed in claim 1, wherein the plumbing configuration provides for a fluid flow path that travels or is located substantially in the same plane, or an in-line plane, from between the inlet to the plumbing configuration to the outlet from the plumbing configuration.

7. The encasement as claimed in claim 6, wherein the inlet to the plumbing configuration is in a plane substantially orthogonal, or different, to the plane of the fluid flow path that travels from between the inlet to the plumbing configuration to the outlet from the plumbing configuration.

8. The encasement as claimed in claim 6, wherein the outlet from the plumbing configuration is in the same or a different plane to the plane of the fluid flow path that travels from between the inlet to the plumbing configuration to the outlet from the plumbing configuration.

9. The encasement as claimed in claim 1, wherein the enclosure is adjustable in size.

10. The encasement as claimed in claim 1, wherein the first housing is to be mounted to a wall or a part of a wall or support structure.

11. The encasement as claimed in claim 1, wherein the enclosure or first housing portion includes one or more flanges for receiving fasteners and fixing to a wall or a part of a wall or a support structure.

12. The encasement as claimed in claim 1, wherein the co-locating devices are: male and female parts engageable with each other at a plurality of pre-determined engagement positions, whether as a series of teeth or detents or castellated arrangements engageable with each other, or as one or a series of male projections and one or a series of female recesses to receive the male projections.

13. The encasement as claimed in claim 1, wherein the second housing portion comprising the plumbing configuration is adjustable in position relative to the first housing portion that is to be fixed in a mounted position so as to accommodate a fluid connection between an inlet to the plumbing configuration and an outlet from a fluid discharging device.

14. The encasement as claimed in claim 1, wherein the encasement or plumbing configuration comprises a manifold for receiving a flow of fluid from one or more fluid discharging devices and for discharging the flow of fluid discharged from the one or more devices.

15. The encasement as claimed in claim 1, wherein the encasement provides for a concealed plumbing configuration.

16. The encasement as claimed in claim 1, wherein housed within the encasement is one or more water supply outlets.

17. The encasement as claimed in claim 1, wherein one or more removable plugs or pop-out sections are removable from one or more wall sections of the encasement to facilitate an access-point for providing a fluid connection to or from a conduit to be housed within the encasement.

18. The encasement as claimed in claim 1, wherein an exterior surface or surfaces of the second housing portion is configured to engage with the one or a series of co-locating devices of the first housing portion, such an engagement being an adjustable engagement for adjusting the relative position of the second housing portion with respect to the first housing portion.

19. The encasement as claimed in claim 1, wherein the position of the second housing portion is laterally adjustable with respect to the first housing portion by re-positioning the engagement of the one or a series of co-locating devices of the second housing portion with respect to the one or a series of co-locating devices of the first housing portion.

20. The encasement as claimed in claim 1, wherein an adjustment of the position of the second housing portion with respect to the first housing portion allows for a longitudinal, lateral, or both longitudinal and lateral, re-positioning of an inlet to the plumbing configuration.

21. The encasement as claimed in claim 1, wherein the first housing portion comprises an aperture, or provision for an aperture to be made, through which a fluid connection is made for connecting to an outlet of the plumbing configuration, or for connecting a fluid supply to a device or fixture, the aperture or provision for the aperture to be made being provided in or through one or more of: a bottom wall, a side wall, a rear wall.

22. The encasement as claimed in claim 1, wherein a fluid connection is made with the outlet of the plumbing configuration, the fluid connection being maintained regardless of a re-positioning of the plumbing configuration with respect to the encasement or a re-positioning of the second housing portion with respect to the first housing portion.

23. The encasement as claimed in claim 1, wherein a pre-determined length of the plumbing configuration at and upstream from the outlet from the plumbing configuration is configured to receive a conduit, the conduit extending at least a part of the pre-determined length.

24. The encasement as claimed in claim 23, wherein the pre-determined length of the plumbing configuration has a larger internal diameter than the internal diameter of the remaining fluid flow pathway of the plumbing configuration more upstream.

25. The encasement as claimed in claim 1, wherein the outlet from the plumbing configuration, and for a particular length of the plumbing configuration immediately upstream from the outlet, is configured to internally receive a conduit or pipe therein without interrupting or an interruption to the fluid flow pathway of fluid being discharged from the plumbing configuration.

26. The encasement as claimed in claim 1, wherein a lid or cover is provided to conceal the cavity space of the enclosure.

27. The encasement as claimed in claim 1, wherein a lid or cover is securely fastened to the enclosure to protect the cavity space from unauthorised access.

* * * * *